US008926898B2

(12) United States Patent
Takagi et al.

(10) Patent No.: US 8,926,898 B2
(45) Date of Patent: Jan. 6, 2015

(54) AL BASE ALLOY EXCELLENT IN HEAT RESISTANCE, WORKABILITY AND RIGIDITY

(75) Inventors: Toshiaki Takagi, Kobe (JP); Katsura Kajihara, Kobe (JP); Hideo Hata, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 1199 days.

(21) Appl. No.: 11/910,310

(22) PCT Filed: Mar. 7, 2006

(86) PCT No.: PCT/JP2006/304359

§ 371 (c)(1),
(2), (4) Date: Oct. 1, 2007

(87) PCT Pub. No.: WO2006/103885

PCT Pub. Date: Oct. 5, 2006

(65) Prior Publication Data

US 2009/0041616 A1 Feb. 12, 2009

(30) Foreign Application Priority Data

Mar. 29, 2005 (JP) ..... 2005-095278
Mar. 29, 2005 (JP) ..... 2005-095279

(51) Int. Cl.

| | |
|---|---|
| ***C22C 21/08*** | (2006.01) |
| ***C22C 1/04*** | (2006.01) |
| ***B22F 3/115*** | (2006.01) |
| *C22C 21/00* | (2006.01) |

(52) U.S. Cl.

CPC ..... *C22C 1/0416* (2013.01); *B22F 3/115* (2013.01); *C22C 1/0491* (2013.01); *C22C 21/00* (2013.01)

USPC ..... 420/535; 420/551

(58) Field of Classification Search

USPC ..... 420/535, 551

See application file for complete search history.

(56) References Cited

U.S. PATENT DOCUMENTS 4,435,213 A * 3/1984 Hildeman et al. ..... 75/249

FOREIGN PATENT DOCUMENTS

| | | |
|---|---|---|
| EP | 0 341 714 | 11/1989 |
| EP | 0 796 925 | 9/1997 |
| EP | 0 819 778 | 1/1998 |
| JP | 62 142741 | 6/1987 |
| JP | 1 275732 | 11/1989 |

(Continued)

OTHER PUBLICATIONS

Machine translation of JP 06184712.*

(Continued)

*Primary Examiner* — Rebecca Lee

(74) *Attorney, Agent, or Firm* — Oblon, Spivak, McClelland, Maier & Neustadt, L.L.P.

(57) ABSTRACT

Disclosed is a lightweight aluminum based alloy that is high in strength and elongation properties at high temperatures of around 200° C. to 300° C. and has excellent workability in hot working. Disclosed also is a heat-resistant aluminum based alloy excellent in wear resistance and rigidity. Specifically, an aluminum based alloy contains, in terms of percent by mass, 5% to 10% of Mn; 0.5% to 5% of V; 0.5% to 5% of Cr; 0.5% to 5% of Fe; 1% to 8% of Si; 0.5% to 5% of Ni, with the balance being aluminum and inevitable impurities. The aluminum based alloy has a structure including 35 to 80 percent by volume of an intermetallic compound phase with the balance being an aluminum metal matrix.

10 Claims, 3 Drawing Sheets

(56) References Cited

FOREIGN PATENT DOCUMENTS

| | | |
|---|---|---|
| JP | 5 86426 | 4/1993 |
| JP | 5 195130 | 8/1993 |
| JP | 6 93363 | 4/1994 |
| JP | 6 184712 | 7/1994 |
| JP | 6 235040 | 8/1994 |
| JP | 9 125180 | 5/1997 |
| JP | 10 26002 | 1/1998 |

OTHER PUBLICATIONS

U.S. Appl. No. 12/529,030, filed Aug. 28, 2009, Hata, et al.

* cited by examiner

AL BASE ALLOY EXCELLENT IN HEAT RESISTANCE, WORKABILITY AND RIGIDITY

TECHNICAL FIELD

The present invention relates to an aluminum based alloy excellent in workability and heat resistance and to an aluminum based alloy excellent in wear resistance and rigidity. More specifically, it relates to a heat-resistant aluminum based alloy that is suitably used in machine parts requiring strength at high temperatures of about 200° C. to 300° C. (also referred to as high-temperature strength) and lightness in weight, in uses including automobile or aircraft engine components such as pistons and connecting rods. It also relates to a heat-resistant aluminum based alloy that is suitably used in extruded profile shapes (extrudings) requiring strength at high temperatures and lightness in weight, in uses such as members for precision machines with fine positioning accuracy, high-precision lightweight robot arms, lightweight high-rigidity plate ring chucks, high-precision micro hard disk substrates, and lightweight framed constructional materials.

BACKGROUND ART

Of known melt/cast alloys, various heat-resistant alloys including Al—Cu alloys such as 2618 and other series 2000 aluminum alloys as specified in Japanese Industrial Standards (JIS) have been developed. These alloys, however, do not have sufficient strength when used at high temperatures exceeding 150° C. This is because these Al—Cu alloys ensure their strength owing to finely divided deposits formed as a result of age hardening, and the deposit phase becomes coarse to thereby reduce the strength remarkably when used at temperatures exceeding 150° C.

Aluminum based alloys prepared by rapid solidification techniques have therefore been developed. Aluminum alloys prepared by rapidly quenched powder metallurgy belonging to such rapid solidification techniques can contain larger amounts of alloy elements such as Fe, Cr, Mn, Ni, Ti, and Zr, as compared with the melt/cast aluminum alloys. Accordingly, aluminum based alloys excellent in strength even when used at high temperatures exceeding 150° C. can be obtained by powdering aluminum alloys containing large amounts of these alloy elements through rapid solidification, and compressing and molding the resulting powders (Patent Documents 1 and 2). This is because the alloy elements form dispersed particles of intermetallic compounds with aluminum in the structure, and the dispersed intermetallic compounds are stable even at high temperatures and contribute to higher strength at high temperatures.

A technique for providing high strength has been proposed, in which the fraction of such intermetallic compounds is increased by finely dividing the intermetallic compounds (Patent Document 3).

There has also been developed a lightweight heat-resistant aluminum based alloy, which further contains alloy elements such as Fe, V, Mo, Zr, and Ti, in which intermetallic compounds between these alloy elements and aluminum are finely divided by spray forming belonging to rapid solidification techniques. In addition, a high-strength aluminum based alloy with good wear resistance has been developed, in which excessive silicon (Si) is added to form finely divided silicon primary crystals (Patent Document 4).

In addition, there are also proposed a heat-resistant aluminum based alloy which is amorphous by further containing various alloy elements other than above (Patent Document 5); a heat-resistant aluminum based alloy containing a matrix and quasi-crystals uniformly dispersed in the matrix, which matrix includes a supersaturated solid solution containing two or more transition elements (Patent Document 6); and an impeller prepared by subjecting a rapidly solidified Al—Fe alloy to hot extruding and subsequently to hot forging (Patent Document 7).

Patent Document 1: Japanese Patent No. 2911708 (entire text)

Patent Document 2: Japanese Examined Patent Application Publication (JP-B) No. Hei 07-62189 (entire text)

Patent Document 3: Japanese Unexamined Patent Application Publication (JP-A) No. Hei 05-195130 (entire text)

Patent Document 4: Japanese Unexamined Patent Application Publication (JP-A) No. Hei 09-125180 (entire text)

Patent Document 5: Japanese Examined Patent Application Publication (JP-B) No. Hei 06-21326 (entire text)

Patent Document 6: Japanese Patent No. 3142659 (entire text)

Patent Document 7: Japanese Unexamined Patent Application Publication (JP-A) No. Hei 10-26002 (entire text)

DISCLOSURE OF INVENTION

Problems to be Solved by the Invention

Aluminum based alloys can have increased strength at high temperatures (around 350 MPa at about 200° C. or around 300 MPa at about 300° C.) by increasing the amounts of alloy elements in rapidly quenched powder metallurgy as typically in Patent Documents 1 to 7. Excessively increased amounts of alloy elements, however, cause increased sizes of intermetallic compounds, and this impairs elongation properties at high temperatures.

To improve the elongation properties of such aluminum based alloys, there has been proposed a technique of reducing sizes of intermetallic compounds through hot working such as hot extruding. The resulting alloys, however, undergo cracking during hot working such as hot extruding, because they have poor elongation properties at high temperatures and thereby have poor hot workability.

Under these circumstances, an object of the present invention is to provide an aluminum based alloy that has high strength and elongation properties at high temperatures of around 200° C. to 300° C. and is excellent in workability in hot working.

Excessively large amounts of alloy elements may cause coarse particles of intermetallic compounds. When occurring in constructional materials requiring wear resistance, these coarse compounds cause chipping and thereby reduce wear resistance.

These aluminum based alloys each include an aluminum metal matrix and an intermetallic compound phase and have dispersion strengthened structures, in which the hard intermetallic compound phase is dispersed in the soft aluminum metal matrix.

The aluminum metal matrix in such a dispersion strengthened structure has relatively low strength. Accordingly, when the alloys are used in machine parts requiring strength at high temperatures and lightness in weight, the resulting machine parts will have poor wear resistance and rigidity, because it is difficult to maintain the hard intermetallic compound phase on its surface.

Under these circumstances, another object of the present invention is to provide a heat-resistant aluminum based alloy excellent in wear resistance and rigidity.

Means for Solving the Problems

After intensive investigations under these circumstances, the present inventors found that, if an aluminum based alloy has a volume percentage of intermetallic compound phases of less than 35%, the volume percentage of aluminum metal relatively increases to thereby reduce the heat resistance, wear resistance, and rigidity of the aluminum based alloy. The intermetallic compound phases are formed from alloy elements such as V, Cr, Fe, Cu, Mg, Si, Ni, and Nd and contain Al—Mn intermetallic compounds and other intermetallic compounds. They also found that, if an aluminum based alloy has a volume percentage of these intermetallic compound phases of more than 80%, the intermetallic compounds become coarse to thereby reduce the heat resistance, wear resistance, and rigidity of the aluminum based alloy contrarily, and the relative amount of aluminum metal excessively decreases to thereby reduce the toughness of the aluminum based alloy, and that it is difficult to use the resulting aluminum based alloy as a heat-resistant aluminum based alloy. The present invention has been made based on these findings.

According to an embodiment of the present invention, there is provided a heat-resistant aluminum based alloy which contains, in terms of percent by mass, 5% to 10% of Mn; 0.5% to 5% of V; 0.5% to 5% of Cr; 0.5% to 5% of Fe; 1% to 8% of Si; and 0.5% to 5% of Ni; with the balance being aluminum and inevitable impurities, in which the aluminum based alloy has a structure including 35 to 80 percent by volume of an intermetallic compound phase with the balance being an aluminum metal matrix.

There is also provided a heat-resistant aluminum based alloy according to the present invention, which further contains 5% or less (excluding 0%) of Cu; and 3% or less (excluding 0%) of Mg. By further containing 5% or less of Cu and 3% or less of Mg, the aluminum based alloy may become further resistant to deterioration in strength at high temperatures, elongation properties, and hot workability.

There is further provided a heat-resistant aluminum based alloy according to the present invention, which further contains 0.2% to 2% of Nd. By containing 0.2% or more of Nd, the heat resistance can be improved. By containing 2% or less of Nd, the aluminum based alloy may become further resistant to deterioration in heat resistance and toughness.

The present inventors also found that such heat-resistant aluminum based alloys have improved hot workability to thereby have improved tensile strength at high temperatures, elongation properties, when intermetallic compounds in the metallographic structure of the aluminum based alloys include three or more different phases selected from an Al—Mn—Si phase, an Al—Mg—Cr phase, an Al—Cr—Cu—Fe phase, and an Al—V phase. They further found that, if the total content of Mn, V, Cr, Fe, Si, Cu, and Mg is less than 12%, the specific intermetallic compounds may not be formed in sufficient numbers (amounts) to fail to improve the hot workability and elongation properties and increase the strength at high temperatures; and that, if the total content exceeds the upper limit of 28%, the elements form coarse intermetallic compounds to thereby reduce the strength at high temperatures, elongation properties, and hot workability.

Accordingly, there is also provided a heat-resistant aluminum based alloy according to the present invention, in which the aluminum based alloy has a total content of Mn, V, Cr, Fe, Si, Cu, and Mg of 12% to 28%, and the intermetallic compound phase includes three or more different intermetallic compound phases selected from an Al—Mn—Si intermetallic compound phase, an Al—Mg—Cr intermetallic compound phase, an Al—Cr—Cu—Fe intermetallic compound phase, and an Al—V intermetallic compound phase.

In addition, the present inventors had following findings. When aluminum based alloys containing Mn as an essential component further contain other alloy elements such as V, Cr, Fe, Cu, Mg, Si, Ni, and Nd, one or more of the other alloy elements may be dissolved in an Al—Mn intermetallic compound phase in the metallographic structure under some manufacturing conditions, and the resulting aluminum based alloys can have further excellent wear resistance and rigidity. By controlling the total content of Mn, V, Cr, Fe, Si, and Ni within a range of 15% to 30%, sufficient amounts of alloy elements are dissolved in the Al—Mn intermetallic compound phase and/or the aluminum matrix to thereby improve the heat resistance, rigidity, and wear resistance. By controlling the total content of these alloy elements to 10 percent by mass or more, the aluminum based alloys can have improved strength, toughness, and hardness (strength at high temperatures and wear resistance).

Accordingly, there is provided a heat-resistant aluminum based alloy according to the present invention, in which the aluminum based alloy has a total content of Mn, V, Cr, Fe, Si, and Ni of 15% to 30%, the intermetallic compound phase has a structure including an Al—Mn intermetallic compound phase, and a total of 10 percent by mass or more of one or more elements selected from V, Cr, Fe, Si, and Ni are dissolved in the Al—Mn intermetallic compound phase to form a solid solution.

According to the present invention, there is also provided a heat-resistant aluminum based alloy, in which a total of 0.1 to 10 percent by mass of one or more elements selected from V, Cr, Fe, Si, and Ni are dissolved in the aluminum metal matrix to form a solid solution. This aluminum based alloy is further excellent in wear resistance and rigidity. In addition to solid solution in the Al—Mn intermetallic compound phase, by allowing a total of 0.1 to 10 percent by mass of the alloy elements to be dissolved in the aluminum metal matrix to form a solid solution, the aluminum metal matrix has increased strength. The resulting aluminum based alloy can have increased wear resistance even when used in machine parts for use at high temperatures, because the aluminum metal matrix can maintain the hard intermetallic compound phase on its surface.

There is further provided a heat-resistant aluminum based alloy according to the present invention, in which either one or both of Cu and Mg are further dissolved in the Al—Mn intermetallic compound phase to form a solid solution, and the total amount of the dissolved elements further including Cu and Mg is 10 percent by mass or more. Copper (Cu) and magnesium (Mg) form intermetallic compounds to thereby improve the strength at high temperatures (heat resistance). If the total amount of the alloy elements is less than 10 percent by mass, the aluminum based alloy may not have sufficiently effectively improved strength, toughness, and hardness (strength at high temperatures and wear resistance).

According to the present invention, there is further provided a heat-resistant aluminum based alloy, in which a total of 0.1 to 10 percent by mass of one or more elements selected from V, Cr, Fe, Si, Ni, Cu, and Mg is dissolved in the aluminum metal matrix to form a solid solution.

According to the present invention, there is also provided a heat-resistant aluminum based alloy, in which Nd is further dissolved in the Al—Mn intermetallic compound phase to form a solid solution, and the total amount of the dissolved elements further including Nd is 10 percent by mass or more.

In addition, there is provided a heat-resistant aluminum based alloy, in which a total of 0.1 to 10 percent by mass of one or more elements selected from V, Cr, Fe, Si, Ni, and Nd, or a total of 0.1 to 10 percent by mass of one or more elements selected from V, Cr, Fe, Si, Ni, Cu, Mg, and Nd are dissolved in the aluminum metal matrix to form a solid solution. By allowing a total of 0.1 to 10 percent by mass of these alloy elements to be dissolved also in the aluminum metal matrix to form a solid solution, the aluminum metal matrix may have increased strength. The resulting aluminum based alloy can have increased wear resistance even when used in machine parts for use at high temperatures, because the aluminum metal matrix can maintain the hard intermetallic compound phase being on its surface.

In addition, there is provided a heat-resistant aluminum based alloy according to the present invention, in which the intermetallic compound phase in the aluminum based alloy structure has an average size of 5 μm or less. The resulting aluminum based alloy can have further improved elongation properties and workability at around 200° C. to 300° C. and further increased toughness.

There is further provided a heat-resistant aluminum based alloy according to the present invention, in which the average of greatest lengths of aluminum metal pools divided by the intermetallic compound phase is 40 μm or less. The resulting aluminum based alloy can have further improved elongation properties at around 200° C. to 300° C. and further satisfactory balance between ductility and strength.

Advantages

Aluminum based alloys according to the present invention contain an aluminum metal matrix and large amounts of the specific intermetallic compound phases. However, if the contents of the specific alloy elements are simply increased to excess amounts, the intermetallic compounds become coarse to thereby impair elongation properties at high temperatures, as in the known techniques, although the aluminum based alloy can have increased strength at high temperatures (around 350 MPa at about 200° C.). To improve elongation properties, there is a known technique for reducing the sizes of intermetallic compound as a result of hot working, as described above. This technique, however, causes cracking in hot working.

In contrast, the present inventors found that an aluminum based alloy can have improved hot workability when intermetallic compounds composed of the specific alloy elements in the metallographic structure include three or more different phases selected from the following specific intermetallic compounds.

The specific intermetallic compound phases are four phases including an Al—Mn—Si phase, an Al—Mg—Cr phase, an Al—Cr—Cu—Fe phase, and an Al—V phase. Specifically, an aluminum based alloy can have increased hot workability when intermetallic compounds in the metallographic structure include three or more phases selected from the specific four intermetallic compound phases. By carrying out hot working, the tensile strength and elongation properties at high temperatures can be further improved.

Aluminum based alloys according to the present invention include an aluminum metal matrix and large amounts of the intermetallic compound phases and has a dispersion strengthened structure in which hard intermetallic compound phases are dispersed in a soft aluminum metal matrix. The aluminum metal matrix in such dispersion strengthened structures has relatively low strength. Accordingly, when such an alloy is used in machine parts requiring strength at high temperatures and lightness in weight, the resulting machine parts will have poor wear resistance and rigidity, because it is difficult to maintain the hard intermetallic compound phase being on its surface, as described above.

The wear resistance of an aluminum based alloy is determined to a more extent by the strength of its aluminum matrix when the aluminum based alloy contains larger amounts of alloy elements and thereby contains larger amounts of intermetallic compound phases, as in the present invention. Specifically, an aluminum based alloy should have such higher strength of the aluminum matrix so as to maintain hard intermetallic compound phases being on its surface.

As a solution to this, the present inventors found that, when aluminum based alloys containing Mn as an essential component further contain other alloy elements such as V, Cr, Fe, Cu, Mg, Si, Ni, and Nd, one or more of these other alloy elements may be dissolved in an Al—Mn intermetallic compound phase in the metallographic structure under some manufacturing conditions.

The present inventors also found that, when one or more of the alloy elements constituting intermetallic compounds other than Mn are further dissolved in the Al—Mn intermetallic compound phase, the resulting aluminum based alloy can have further improved heat resistance and wear resistance, as compared with alloys in which the elements are not dissolved in the intermetallic compound phase.

In addition, the present inventors found that one or more of alloy elements such as V, Cr, Fe, Cu, Mg, Si, Ni, and Nd may be dissolved also in the aluminum metal matrix (matrix) of an aluminum based alloy of this type under some manufacturing conditions.

They found that an aluminum based alloy containing one or more of alloy elements such as V, Cr, Fe, Cu, Mg, Si, Ni, and Nd dissolved in the aluminum metal matrix (matrix) can have improved heat resistance and wear resistance, as compared with alloys in which these alloy elements are not dissolved therein.

They also found that an aluminum based alloy can have both excellent Young's modulus at ordinary temperature and excellent Young's modulus at high temperatures when it contains Al—Mn intermetallic compounds as a principal phase. The Young's modulus at ordinary temperature and Young's modulus at high temperatures indicate the rigidity of an aluminum based alloy. The term "Al—Mn intermetallic compound" as used in the present invention refers to an intermetallic compound that contains manganese (Mn) in a largest content next to aluminum among Mn and other constitutional elements (analyzed elements) constituting the intermetallic compound. The contents of these elements are determined by the after-mentioned analysis method.

BEST MODE FOR CARRYING OUT THE INVENTION

Figure 1:
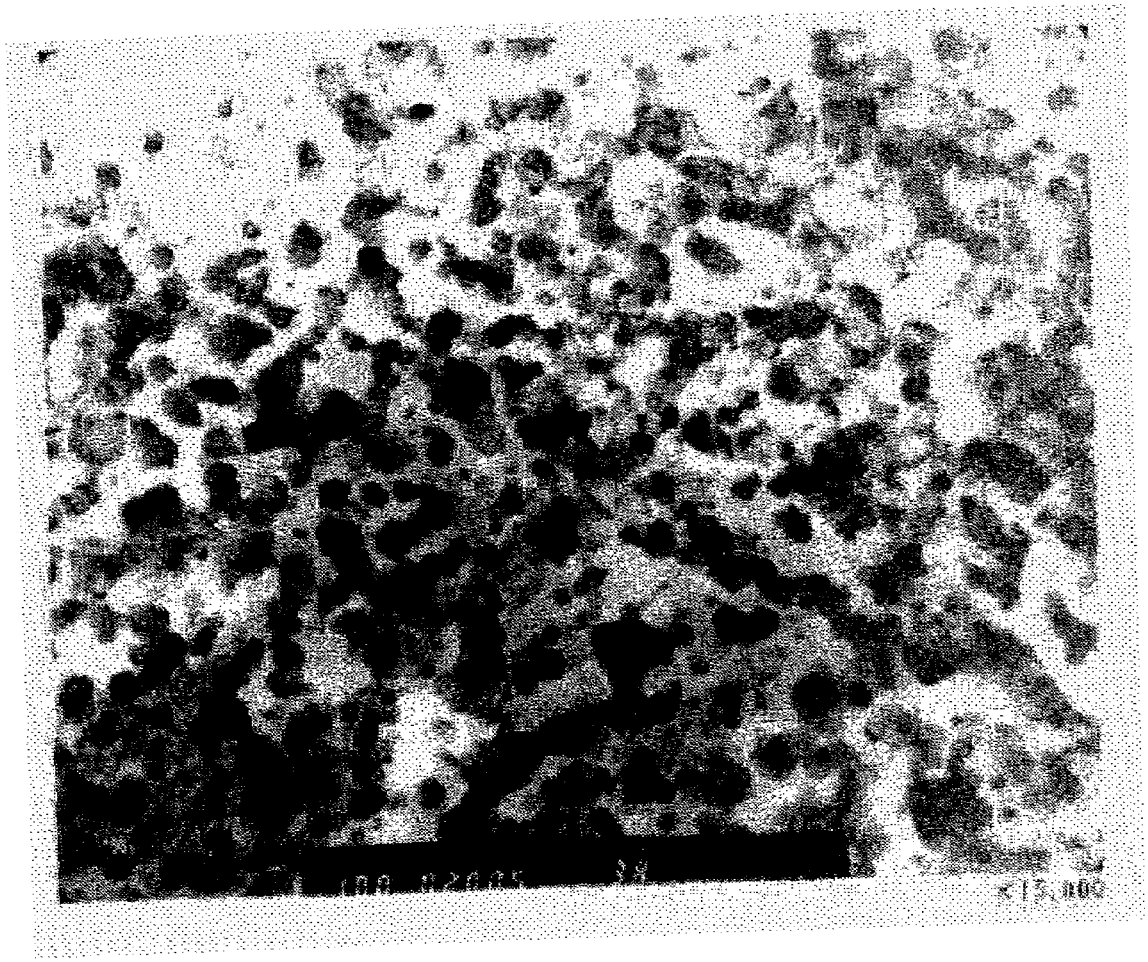
FIG. 1 is a photograph (in place of drawing) showing the structure of an aluminum based alloy according to the present invention taken with a transmission electron microscope (TEM) at a magnification of 15000 times.

First Embodiment (Composition of Aluminum Based Alloy)

The chemical component composition (unit: percent by mass) of aluminum based alloys according to an embodiment of the present invention excellent in heat resistance and hot workability will be illustrated below, including reasons for specifying respective elements.

Aluminum based alloys according to the present invention each contain, as basic chemical component composition, 5% to 10% of Mn; 0.5% to 5% of V; 0.5% to 5% of Cr; 0.5% to 5% of Fe; 1% to 8% of Si; 5% or less (excluding 0%) of Cu; 3% or less (excluding 0%) of Mg; and 1% to 5% of Ni, in a total content of Mn, V, Cr, Fe, Si, Cu, and Mg of 12% to 28%, with the balance being aluminum and inevitable impurities. By containing specific plural elements V, Cr, Fe, Cu, Mg, and Si in combination with Mn, the aluminum based alloys contain specific plural intermetallic compounds concurrently to thereby have both improved strength at high temperatures and improved hot workability.

(Mn)

Manganese (Mn) constitutes Al—Mn intermetallic compounds such as Al—Mn—Si intermetallic compounds, which are most abundant among intermetallic compounds in an aluminum based alloy according to the present invention. Thus, manganese acts to improve the strength at high temperatures (heat resistance). The Mn content is set within a range of 5% to 10%. If the Mn content is less than the lower limit of 5%, the element fails to form sufficient amounts (numbers) of Al—Mn intermetallic compounds and thereby fails to improve the hot workability, elongation properties, and strength at high temperatures. In contrast, if it exceeds the upper limit of 10%, manganese forms coarse compounds, and this has the opposite effect of reducing the strength at high temperatures, elongation properties, and hot workability. The Mn content is more preferably within a range of 5.5% to 9%.

(V)

Vanadium (V) forms Al—V intermetallic compounds and acts to improve the strength at high temperatures (heat resistance). The V content herein is set within a range of 0.5% to 5%. If the V content is less than 0.5%, the element fails to form sufficient amounts (numbers) of Al—V intermetallic compounds and fails to improve the hot workability, elongation properties, and strength at high temperatures. In contrast, if it exceeds the upper limit of 5%, the element forms coarse compounds, to thereby reduce the strength at high temperatures, elongation properties, and hot workability contrarily. The V content is more preferably within a range of 0.6% to 4%.

(Cr)

Chromium (Cr) forms Al—Mg—Cr and Al—Cr—Cu—Fe intermetallic compounds and thereby acts to improve the strength at high temperatures (heat resistance). The Cr content is set within a range of 0.5% to 5%. If the Cr content is less than the lower limit of 0.5%, the element fails to form sufficient amounts (numbers) of Al—Mg—Cr and Al—Cr—Cu—Fe intermetallic compounds and fails to improve the hot workability, elongation properties, and strength at high temperatures. In contrast, if it exceeds the upper limit of 5%, the element forms coarse compounds, to thereby reduce the strength at high temperatures, elongation properties, and hot workability contrarily. The Cr content is more preferably within a range of 0.6% to 4.5%.

(Fe)

Iron (Fe) forms Al—Cr—Cu—Fe intermetallic compounds and acts to improve the strength at high temperatures (heat resistance). The Fe content is set within a range of 0.5% to 5%. If the Fe content is less than the lower limit of 0.5%, the element fails to form sufficient amounts (numbers) of Al—Cr—Cu—Fe intermetallic compounds and fails to improve the hot workability, elongation properties, and strength at high temperatures. In contrast, if it exceeds the upper limit of 5%, the element forms coarse compounds, to thereby reduce the strength at high temperatures, elongation properties, and hot workability contrarily. The Fe content is more preferably within a range of 0.6% to 4.5%.

(Si)

Silicon (Si) forms Al—Mn—Si intermetallic compounds and acts to improve the strength at high temperatures (heat resistance). The Si content is set within a range of 1% to 8%. If the Si content is less than the lower limit of 1%, the element fails to form sufficient amounts (numbers) of Al—Mn—Si intermetallic compounds and fails to improve the hot workability, elongation properties, and strength at high temperatures. In contrast, if it exceeds the upper limit of 8%, the element forms coarse compounds, to thereby reduce the strength at high temperatures, elongation properties, and hot workability contrarily. The Si content is more preferably within a range of 1.5% to 7%.

(Cu)

Copper (Cu) forms Al—Cr—Cu—Fe intermetallic compounds and thereby acts to improve the hot workability, elongation properties, and strength at high temperatures (heat resistance) even in a trace amount as with those of usual impurities. Accordingly, the Cu content is set within a range of 5% or less (excluding 0%). If the Cu content exceeds the upper limit of 5%, the element forms coarse compounds, to thereby reduce the strength at high temperatures, elongation properties, and hot workability contrarily. The Cu content is more preferably within a range of 4.5% or less.

(Mg)

Magnesium (Mg), even in a trace amount as with those of usual impurities, forms sufficient amounts (numbers) of Al—Mg—Cr intermetallic compounds and acts to improve the hot workability, elongation properties, and strength at high temperatures (heat resistance). Accordingly, the Mg content is set within a range of 3% or less (excluding 0%). If the Mg content exceeds the upper limit of 3%, the element forms coarse compounds, to thereby reduce the strength at high temperatures, elongation properties, and hot workability contrarily. The Mg content is more preferably within a range of 2.5% or less.

(Ni)

Nickel (Ni) is dissolved in the aluminum metal matrix to form a solid solution and acts to improve the strength at high temperatures (heat resistance). The Ni content is set within a range of % 1 to 5%. If the Ni content is less than the lower limit of 0.5%, the element fails to improve the hot workability, elongation properties, and strength at high temperatures. In contrast, if the Ni content exceeds the upper limit of 5%, the strength at high temperatures, elongation properties, and hot workability are rather reduced. The Ni content is more preferably within a range of 0.6% to 4.5%.

(Total Content of Mn, V, Cr, Fe, Si, Cu, and Mg)

According to an embodiment of the present invention, the total content of seven elements, i.e., Mn, V, Cr, Fe, Si, Cu, and Mg that form the specific intermetallic compounds is specified, to ensure sufficient amounts of the specific intermetallic compounds and to improve the strength at high temperatures and hot workability. The total content of these elements Mn, V, Cr, Fe, Si, Cu, and Mg is set within a range of 12% to 28%.

If the total content is less than the lower limit of 12%, these elements may fail to form sufficient amounts (numbers) of the specific intermetallic compounds and may fail to improve the hot workability, elongation properties, and strength at high temperatures effectively. In contrast, if the total content exceeds the upper limit of 28%, the elements may form coarse compounds, to thereby reduce the strength at high temperatures, elongation properties, and hot workability contrarily. The total content of these seven elements is more preferably within a range of 16% to 26%.

(Intermetallic Compound Phase)

According to an embodiment of the present invention, the metallographic structure of the aluminum based alloy contains three or more different phases selected from Al—Mn—Si, Al—Mg—Cr, Al—Cr—Cu—Fe, and Al—V phases to improve the hot workability, as is described above. The number of these different phases is preferably as much as possible.

If the volume percentage of these intermetallic compound phases is excessively small, these intermetallic compound phases are insufficient but the volume percentage of aluminum metal is relatively large. The resulting aluminum based alloy may be insufficient in strength at high temperatures, elongation properties, and hot workability.

In contrast, if the volume percentage of these intermetallic compound phases is excessively large, the elements may form coarse compounds, to thereby reduce the strength at high temperatures, elongation properties, and hot workability contrarily. In addition, the amount of aluminum metal becomes relatively excessively small, and the resulting aluminum based alloy may have insufficient toughness and become brittle, and may not be used as a heat-resistant aluminum based alloy.

Accordingly, the aluminum based alloy structure should contain these specific intermetallic compound phases in a volume percentage of 35% to 80%, and preferably 40% to 75%. Aluminum based alloys according to the present invention may structurally further contain other intermetallic compound phases in addition to these specific principal phases, within ranges not adversely affecting the properties of the aluminum based alloys.

(Specific Examples of Intermetallic Compounds)

In the structures of aluminum based alloys according to the present invention, the term "Al—Mn—Si intermetallic compound" refers to an intermetallic compound that contains Mn and Si, in which either one of Mn and Si has the largest content next to aluminum, as determined by elemental analysis of the intermetallic compound. Representative examples of such Al—Mn—Si intermetallic compounds include $Al_5Mn_{12}Si_7$ and other intermetallic compounds The term "Al—Mg—Cr intermetallic compound" refers to an intermetallic compound that contains Mg and Cr, in which either one of Mg and Cr has the largest content next to aluminum, as determined by elemental analysis of the intermetallic compound. Representative examples of this include $Al_{18}Mg_3Cr_2$ and other intermetallic compounds.

The term "Al—Cr—Cu—Fe intermetallic compound" refers to an intermetallic compound that contains Cr, Cu, and Fe, in which one of Cr, Cu, and Fe has the largest content next to aluminum (Al), as determined by elemental analysis of the intermetallic compound. Representative examples of this include $Al_{13}CrCu_4Fe_2$ and other intermetallic compounds.

The term "Al—V intermetallic compound" refers to an intermetallic compound that contains V, in which V has the largest content next to aluminum (Al), as determined by elemental analysis of the intermetallic compound. Representative examples of this include $Al_{11}V$ and other intermetallic compounds.

(Average Size of Intermetallic Compounds)

Intermetallic compounds such as the Al—Mn—Si, Al—Mg—Cr, Al—Cr—Cu—Fe, and Al—V intermetallic compounds in the structure of an aluminum based alloy according to an embodiment of the present invention preferably have a small average size of 5 μm or less, in order to improve elongation properties and workability of the aluminum based alloy, as is described above. By finely dividing the intermetallic compounds so as to have such a small average size, the aluminum based alloy is also improved in toughness.

The strength at high temperatures increases with increasing contents of respective alloy elements and increasing amounts of intermetallic compounds. In this case, however, the average size of intermetallic compounds more affects the toughness of the aluminum based alloy than aluminum based alloys containing alloy elements in less amounts. In this connection, when intermetallic compounds have an average size of more than 5 μm, the resulting aluminum based alloy may have insufficient elongation properties and workability even if the aluminum based alloy satisfies the above conditions.

(Determination of Average Size of Intermetallic Compounds)

The average size of intermetallic compounds (intermetallic compound particles) is determined with a transmission electron microscope (TEM) of a magnification of 5000 to 15000 times in combination with an energy dispersive X-ray spectroscope (EDX). Specifically, intermetallic compounds are traced in an observed image of the structure in visual field of TEM, central diameters of intermetallic compound particles are determined using an image analyzing software Image-ProPlus supplied from MEDIA CYBERNETICS, Inc., and the central diameters are averaged. Ten visual fields are observed, and the average sizes in individual visual fields are further averaged to determine the average size of intermetallic compounds. FIG. 1 is a photograph in place of drawing showing the structure of an aluminum based alloy according to the present invention (Inventive Sample 1-1 in after mentioned Experimental Examples) taken with a TEM at a magnification of 15000 times. In FIG. 1, a multiplicity of black to gray dots indicate intermetallic compounds (particles) with an average size of 5 μm or less. White areas surrounded by the multiplicity of black to gray dots indicate aluminum metal pools (aluminum matrix) in FIG. 1.

(Greatest Lengths of Metallic Aluminum Pools)

Figure 2:
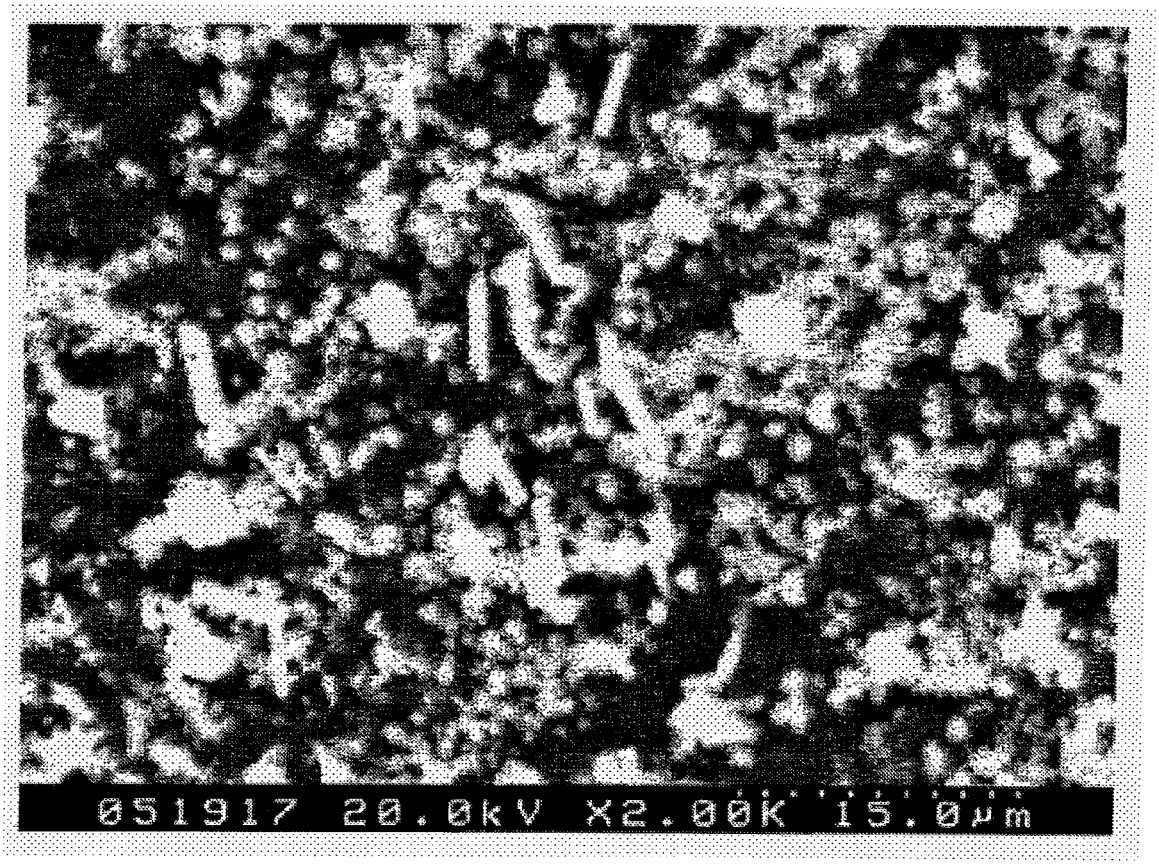
FIG. 2 is a photograph (in place of drawing) showing the structure of an aluminum based alloy according to the present invention taken with a scanning electron microscope (SEM) at a magnification of 500 times.

FIG. 2 is a photograph in place of drawing showing the structure of an aluminum based alloy taken with a scanning electron microscope (SEM) at a magnification of 500 times. The aluminum based alloy shown in FIG. 2 is an aluminum based alloy as Inventive Sample 1-1 in after-mentioned Experimental Examples having an average of greatest lengths (maximum lengths) of aluminum metal pools of 40 μm or less. In FIG. 2, a multiplicity of white areas indicate intermetallic compounds (particles), and black areas surrounded by the white areas indicate aluminum metal pools (aluminum matrix), in contrast to FIG. 1.

Such aluminum metal pools are divided by intermetallic compound phases. The average of greatest lengths of aluminum metal pools is determined by measuring greatest lengths of respective aluminum metal pools indicated as black areas (black streaky patterns) in the visual field according to the after-mentioned procedure, and averaging the measured greatest lengths.

FIG. 2 demonstrates that the aluminum based alloy according to the present invention contains an intermetallic compound phase in a large volume percentage, and plural (respective) intermetallic compound particles come in contact with each other and form an aggregate (continuous body), namely, an intermetallic compound phase. In other words, aluminum metal pools are finely divided (partitioned) by the intermetallic compound phase.

Accordingly, the term "aluminum metal pools" as used in the present invention refers to an aluminum matrix phase divided (surrounded) by such intermetallic compound phase. The term "intermetallic compound(s)" as used in the present invention refers to a multiplicity of white dots (particles) in FIG. 2, and the term "intermetallic compound phase" as used in the present invention refers to the aggregate (continuous body) formed by these respective intermetallic compound particles in contact with each other.

With decreasing greatest lengths of aluminum metal pools, the aluminum metal pools and the intermetallic compound phase are more uniformly dispersed in the aluminum based alloy structure to thereby improve or ensure the elongation properties at around 200° C. to 300° C. and the balance between ductility and strength of the aluminum based alloy. In contrast, if aluminum metal pools have excessively large greatest lengths, the resulting aluminum based alloy may have insufficient elongation properties and workability, even when it satisfies the above conditions.

More specifically, with increasing sizes of aluminum metal pools, the aluminum metal pools and the intermetallic compound phase are inevitably dispersed more heterogeneously in the aluminum based alloy structure. Thus, there may occur many uneven regions where the intermetallic compound phase is dense and where the intermetallic compound phase is absent or non-dense in the aluminum based alloy structure. The uneven dispersion of hard intermetallic compound phase and soft aluminum metal pools may cause reduction in elongation properties, balance between ductility and strength, or workability.

Consequently, aluminum metal pools are preferably finely divided by the intermetallic compound phase so as to have an average of their greatest lengths of 40 μm or less, and more preferably 35 μm or less.

A preform structure prepared by rapid solidification such as spray forming and subjected to no further process may often have large aluminum metal pools. This is as with an article prepared by subjecting an aluminum based alloy to rapid solidification to yield a preform, and compressing and molding the preform by CIP or HIP.

Accordingly, an aluminum alloy preform prepared by rapid solidification as intact or after CIP or HIP should be subjected to hot working such as forging, extruding, and/or rolling, in order to allow aluminum metal pools divided by an intermetallic compound phase to have an average of greatest lengths of 40 μm or less, while increasing the volume percentage of the intermetallic compound phase. Such hot working (plastic working) reduces the sizes of aluminum metal pools and allows the aluminum metal pools and intermetallic compound phase to be finely and uniformly dispersed in the aluminum based alloy structure. In this connection, the HIP or CIP process does not act to finely divide the aluminum metal pools effectively.

(Determination of Greatest Lengths of Metallic Aluminum Pools)

The magnification in SEM is set according to the greatest lengths of aluminum metal pools, as described in detail in after-mentioned Experimental Examples, so as to reduce the measurement error and to increase reproducibility in measurement of the greatest lengths of aluminum metal pools. If the magnification is excessively large, the size of visual field is smaller than the greatest lengths of aluminum metal pools. In contrast, if it is excessively small, aluminum metal pools may not be satisfactorily identified.

(Manufacturing Process)

A manufacturing process of aluminum based alloys according to the present invention will be illustrated below. The structures and properties of aluminum based alloys according to the present invention may be obtained by subjecting aluminum alloy preforms prepared by rapid solidification as intact or after CIP or HIP to hot working (plastic working) such as forging, extruding, and/or rolling.

It is difficult to prepare aluminum based alloys according to the present invention by a common melting and scanning procedure, because they contain large amounts of alloy elements and large amounts of deposited intermetallic compound phases. In addition, when aluminum alloy preforms prepared by rapid solidification or those after CIP or HIP are not subjected to such hot working, the structures and properties of aluminum based alloys according to the present invention may not be obtained.

(Rapidly Quenched Powder Metallurgy)

An aluminum based alloys according to an embodiment of the present invention may be manufactured by rapidly quenched powder metallurgy belonging to rapid solidification techniques. In this case, it is desirable to classify atomized particles (powder) of an aluminum alloy having the composition as specified in the present invention and to use finely divided particles having an average particle diameter of 20 μm or less, and preferably 10 μm or less. Atomized particles having an average particle diameter exceeding 20 μm are cooled too slowly and thereby form a coarse intermetallic compound phase. Accordingly, when atomized particles having an average particle diameter of more than 20 μm are used, an aluminum based alloy according to the present invention may not be possibly obtained. By compressing and molding finely divided particles having an average particle diameter of 20 μm or less alone by CIP, an aluminum alloy preform can be obtained.

(Spray Forming)

However, of rapid solidification techniques, spray forming is desirable to allow the aluminum based alloy structure to surely contain 35 to 80 percent by volume of intermetallic compound phases that include three or more phases selected from an Al—Mn—Si intermetallic compound phase, an Al—Mg—Cr intermetallic compound phase, an Al—Cr—Cu—Fe intermetallic compound phase, and an Al—V intermetallic compound phase.

The spray forming provides a significantly higher cooling/solidifying rate than common melting/casting (ingot making) techniques, and can thereby finely divide intermetallic compounds and aluminum metal matrix, and further improve the workability and heat resistance of the aluminum based alloy. In other words, the cooling/solidifying rate of spray forming is suitable for forming and finely dividing respective intermetallic compound phases.

However, the melting condition and cooling/solidifying rate should be optimized in any of rapidly quenched powder metallurgy and spray forming. According to a preferred embodiment, an aluminum alloy having the composition as specified in the present invention is melted at a melting temperature of 1100° C. to 1600° C., the molten metal is cooled at a cooling rate of 200° C. per hour or more to a spray starting temperature, spraying of the molten metal is started at a temperature of 900° C. to 1200° C., to yield a rapidly quenched powder or to yield a preform through spray forming.

(Melting Condition)

The melting temperature is set at 1100° C. or higher, in order to completely melt respective intermetallic compound phases in an aluminum alloy having the composition as specified in the present invention. When the aluminum based alloy has larger contents of alloy elements, it is desirable to set the melting temperature to a higher temperature of 1100° C. or higher, so as to completely melt respective intermetallic compound phases. There is no need, however, of setting the melting temperature at higher than 1600° C.

(Spraying Condition)

It is desirable to cool the molten metal at a cooling rate of 200° C. per hour or more to a spray starting temperature and to start the spraying of the molten metal at a temperature of 900° C. to 1200° C., to yield a rapidly quenched powder or to yield a preform through spray forming. The metal is melted at a high temperature in order to completely melt intermetallic compound phases. The molten metal is once cooled before starting the spraying. This is effective for crystallizing an intermetallic compound to some extent and for crystallizing fine crystals of other intermetallic compounds with crystals of the crystallized intermetallic compound as nuclei during spray forming. By starting the spraying at a relatively low temperature, the cooling rate of spraying can be set at high level to thereby yield crystallized intermetallic compounds having further reduced sizes.

More specifically, such a pattern control is carried out as to cool the molten metal to a spray starting temperature at a cooling rate of 200° C. per hour or more. By this pattern control, Al—Cr and Al—Fe intermetallic compounds are crystallized to some extent before starting to spray. These intermetallic compounds are effective for finely dividing other intermetallic compounds. Using crystals of these intermetallic compounds as nuclei, Al—Mn intermetallic compounds are crystallized as fine crystals during spraying. Without carrying out this pattern control, crystallized intermetallic compounds may not form fine particles.

If the cooling rate of the molten metal to the spray starting temperature is less than 200° C. per hour, the intermetallic compounds may not be crystallized as fine crystals, and the crystallized intermetallic compounds may not have sufficiently small sizes.

The spray starting temperature of the molten metal affects the cooling/crystallizing rate during the spraying process. Specifically, the spray starting temperature of the molten metal is preferably low for the purpose of increasing the cooling rate. However, if the spray starting temperature is lower than 900° C., intermetallic compounds may be crystallized in the molten metal before the spraying process, and this may often cause clogging of nozzles. In contrast, if the spray starting temperature exceeds 1200° C., the cooling rate during the spraying process may be excessively low, and this may often cause coarse intermetallic compounds.

It is important to set the cooling rate in the spraying process (spray forming process) at a sufficiently high rate. At such a sufficiently high cooling rate, crystal nuclei of intermetallic compounds form at a high frequency to thereby prevent the occurrence of coarse intermetallic compound particles and to form finely divided intermetallic compound phases. In addition, such finely divided intermetallic compound particles come in contact with adjacent particles at a less frequency to thereby yield intermetallic compound phases having less outer sizes.

In this connection, general spray forming techniques are oriented to yield compact or dense preforms so as to improve the strength. Accordingly, the cooling rate is set at low level so as to yield such a loose solidification state as to form dense preforms. As a result, it is difficult to form fine intermetallic compound phases according to the general spray forming techniques. For example, when a preform has a porosity of 1 percent by mass or less as in Patent Document 4, the cooling rate is apparently excessively low, and, as a natural next step, fine intermetallic compound phases as in the present invention are not obtained, and the resulting intermetallic compound phases are coarse.

(Cooling Condition)

The cooling rate during the forming process of rapidly quenched powder or spray forming (during the spraying process) can be controlled, for example, by a gas/metal ratio (G/M ratio: the amount of a gas blown to a unit mass of the molten metal). The G/M ratio in the present invention is preferably higher so as to yield a higher cooling rate. This yields fine intermetallic compound phases, and predetermined amounts of respective elements can be dissolved in the aluminum metal matrix, as specified in the present invention. Other elements than those constituting the intermetallic compounds can also be forcedly dissolved in intermetallic compound phases.

If the G/M ratio is excessively low, the cooling rate may be relatively low, and it may be difficult to dissolve predetermined amounts of respective elements in the aluminum metal matrix and to dissolve other elements than those constituting the intermetallic compounds in intermetallic compound phases forcedly. In addition, the resulting intermetallic compound phases may become coarse. However, an excessively high G/M ratio may reduce the yield of preform (deposition efficiency of the molten metal).

It is recommended to set the lower limit of the G/M ratio satisfying these conditions to, for example, 8 $Nm^3$/kg or more, preferably 9 $Nm^3$/kg or more, and more preferably 10 $Nm^3$/kg or more, and the upper limit of the G/M ratio to, for example, 20 $Nm^3$/kg or less, and preferably 17 $Nm^3$/kg or less.

(Densification)

A powder prepared by rapidly quenched powder metallurgy is subjected to CIP and is then encapsulated in vacuo to yield an aluminum alloy preform. An aluminum alloy in the form of a preform prepared by spray forming is hermetically sealed in a vacuum vessel and then subjected to HIP.

Conditions in hot isostatic pressing (HIP) are not specifically limited, but it is recommended to carry out HIP on the preform encapsulated in a vacuum vessel, for example, at a temperature of 450° C. to 600° C., a pressure of 80 MPa (800 atmospheres) or more for 1 to 10 hours. This heat treatment process acts to further deposit Al—Mn precipitates to thereby reduce the average size of intermetallic compounds. If the temperature and pressure are excessively low, or if the process time is excessively short, pores may often remain. If the temperature is excessively high or the time is excessively long, intermetallic compound phases may often become coarse, and solid solutions in aluminum matrix may decrease in amount.

From this point, the temperature is preferably within a range of about 500° C. to about 600° C., and especially preferably about 550° C. to about 600° C., and the pressure is preferably 900 MPa or more, and especially preferably 1000 MPa or more. The upper limit of the pressure is not specifically limited, but the pressure is generally set to 2000 MPa or less, because an excessively high pressure does not further increase the effects. The process time is preferably about 1 to about 5 hours, and especially preferably about 1 to about 3 hours.

(Hot Working)

The structures and properties of aluminum based alloys according to the present invention can be obtained by subjecting aluminum alloy preforms prepared by rapid solidification further to hot working (plastic working) such as forging, extruding, and/or rolling, as is described above. If rapidly solidified aluminum alloy preforms as intact or after CIP or HIP are not subjected to hot working, the structures and properties of aluminum based alloys according to the present invention may not be obtained.

The hot working such as forging, extruding, and/or rolling enables more fine and uniform dispersion of intermetallic compound phases in the aluminum based alloy structure. However, the processing temperature in hot working such as forging, extruding, and/or rolling is preferably set within a range of 450° C. to 600° C. Hot working carried out at temperatures within this range enables further fine and uniform dispersion of intermetallic compound phases.

If the processing temperature in hot working is as high as exceeding 600° C., intermetallic compound phases may excessively deposit, intermetallic compounds may not be dissolved in the aluminum matrix in sufficient amounts, and intermetallic compound phases may become coarse. In contrast, if the processing temperature is lower than 400° C., effectively fine intermetallic compounds may not be obtained even by hot working.

Likewise, the strain rate in such hot working is preferably set within a range of $10^{-4}$ to $10^{-0}$ (1/s). If the strain rate is higher than this range, the advantages of hot working may not be sufficiently obtained. If the strain rate is lower than this range, intermetallic compound phases may deposit and become coarse.

Aluminum based alloys after the hot working are used as aluminum based alloy products as intact or after further subjected to proper processing such as machining.

Second Embodiment (Composition of Aluminum Based Alloy)

The chemical component composition (unit: percent by mass) of aluminum based alloys according to another embodiment of the present invention excellent in heat resistance, rigidity, and wear resistance will be illustrated below, including reasons for specifying respective elements.

Aluminum based alloys according to another embodiment of the present invention each contain, as basic chemical composition in terms of percent by mass, 5% to 10% of Mn; 0.5% to 5% of V; 0.5% to 5% of Cr; 0.5% to 5% of Fe; 1% to 8% of Si; and 0.5% to 5% of Ni, in a total content of these six elements of 15% to 30%, with the balance being aluminum and inevitable impurities. By containing specific plural elements V, Cr, Fe, Si, and Ni in addition to Mn, the heat resistance and rigidity, as well as wear resistance, are effectively improved.

The aluminum based alloys according to the present invention may further selectively contain, in addition to the basic chemical composition, either one or both of 0.5% to 5% of Cu and 0.5% to 3% of Mg, and/or they may further contain 0.2% to 2% of Nd.

(Mn)

Manganese (Mn) constitutes Al—Mn intermetallic compounds such as Al—Mn—Si intermetallic compounds which are most abundant among intermetallic compounds in an aluminum based alloy according to the present invention. Manganese (Mn) thereby acts to improve the strength at high temperatures (heat resistance). In addition, aluminum based alloys can have excellent Young's modulus at ordinary temperature and excellent Young's modulus at high temperatures by containing Al—Mn intermetallic compounds as a principal phase. In addition, aluminum based alloys can have further improved heat resistance and wear resistance by further containing at least one of the alloy elements other than Mn, as a solid solution in the Al—Mn intermetallic compound phase. In this connection, the parameters Young's modulus at ordinary temperature and Young's modulus at high temperatures indicate the rigidity of an aluminum based alloy.

To exhibit these advantages, the Mn content is set within a range of 5% to 10%. If the Mn content is less than the lower limit of 5%, the element fails to form sufficient amounts (numbers) of Al—Mn intermetallic compounds and fails to improve the properties such as strength at high temperatures, wear resistance, and rigidity. In contrast, if it exceeds the upper limit of 10%, manganese forms coarse compounds to thereby adversely affect these properties contrarily. The Mn content is more preferably within a range of 5.5% to 9%.

(V)

Vanadium (V) forms Al—V intermetallic compounds and acts to improve the strength at high temperatures (heat resistance). The V content is set within a range of 0.5% to 5%. If the V content is less than the lower limit of 0.5%, the element fails to form sufficient amounts (numbers) of Al—V intermetallic compounds and fails to improve the strength at high temperatures. In contrast, if it exceeds the upper limit of 5%, the element forms coarse compounds to thereby adversely affect the strength at high temperatures. The V content is more preferably within a range of 0.6% to 4%.

(Cr)

Chromium (Cr) forms Al—Mg—Cr and Al—Cr—Cu—Fe intermetallic compounds and acts to improve the strength at high temperatures (heat resistance). The Cr content is set within a range of 0.5% to 5%. If the Cr content is less than the lower limit of 0.5%, the element fails to form sufficient amounts (numbers) of Al—Mg—Cr and Al—Cr—Cu—Fe intermetallic compounds, to fail to increase the strength at high temperatures sufficiently. In contrast, if it exceeds the upper limit of 5%, the element forms coarse compounds to thereby reduce the strength at high temperatures contrarily. The Cr content is more preferably within a range of 0.6% to 4.5%.

(Fe)

Iron (Fe) forms Al—Cr—Cu—Fe intermetallic compounds and acts to improve the strength at high temperatures (heat resistance). The Fe content is set within a range of 0.5% to 5%. If the Fe content is less than the lower limit of 0.5%, the element fails to form sufficient amounts (numbers) of Al—Cr—Cu—Fe intermetallic compounds, to fail to improve the strength at high temperatures sufficiently. In contrast, if it exceeds the upper limit of 5%, the element forms coarse compounds to thereby reduce the strength at high temperatures contrarily. The Fe content is more preferably within a range of 0.6% to 4.5%.

(Ni)

Nickel (Ni) is dissolved in the aluminum metal matrix to form a solid solution and acts to improve the strength at high temperatures (heat resistance). The Ni content is set within a range of 0.5% to 5%. If the Ni content is less than the lower limit of 0.5%, sufficiently high strength at high temperatures is not obtained. In contrast, if it exceeds the upper limit of 5%, the strength at high temperatures is rather reduced. The Ni content is more preferably within a range of 0.6% to 4.5%.

(Si)

Silicon (Si) forms Al—Mn—Si intermetallic compounds and acts to improve the strength at high temperatures (heat resistance). The Si content is set within a range of 1% to 8%. If the silicon content is less than the lower limit of 1%, the element fails to form sufficient amounts (numbers) of Al—Mn—Si intermetallic compounds and thereby fails to sufficiently improve the strength at high temperatures. In contrast, if it exceeds the upper limit of 8%, the element forms coarse compounds to thereby reduce the strength at high temperatures contrarily. The Si content is more preferably within a range of 1.5% to 7%.

(Total Content of Six Elements)

The total content of these six elements of Mn, V, Cr, Fe, Si, and Ni is further specified according to an embodiment of the present invention, in order to ensure sufficient amounts of solid solutions of alloy elements in an Al—Mn intermetallic compound phase and aluminum matrix to thereby surely improve the heat resistance, rigidity, and wear resistance. Specifically, the total content of these six elements (total sum of the contents of these six elements) is set within a range of 15% to 30%, and more preferably 16% to 29%.

In aluminum based alloys according to the present invention containing an aluminum metal matrix and intermetallic compound phases, the aluminum metal matrix is soft, and the intermetallic compound phases are hard. Accordingly, the aluminum based alloys according to the present invention have structures in which the hard intermetallic compound phases are dispersed in the soft aluminum metal matrix. The hard intermetallic compound phases act as a principal phase to allow the aluminum based alloys to have heat resistance, wear resistance, rigidity, and high-temperature fatigue strength. In contrast, the soft aluminum metal matrix plays a role as a binder or a substrate (matrix) for the hard intermetallic compound phases so as to allow the intermetallic compound phases to exhibit their functions.

When the alloy elements are dissolved to form a solid solution in the AL-Mn intermetallic compound phases and the aluminum matrix, the functions of the intermetallic compound phases and the aluminum metal matrix may further be exhibited. Consequently, if the total content of the six elements is less than the lower limit of 15%, the alloy elements are not sufficiently dissolved in the AL-Mn intermetallic compound phases and the aluminum matrix, respectively. Thus, the resulting aluminum based alloy may not have effectively improved heat resistance and wear resistance.

In contrast, if the total content of the six elements exceeds the upper limit of 30%, the resulting aluminum based alloy may have poor toughness and thereby be insufficient in strength at high temperatures contrarily, although it may have a structure containing an AL-Mn intermetallic compound phase further containing solid solutions of any of the alloy elements other than Mn.

Other selectively added elements will be illustrated below.

(Cu and/or Mg)

Copper (Cu) and magnesium (Mg) both form intermetallic compounds and act to improve the strength at high temperatures (heat resistance).

Copper (Cu), if contained in a content of 0.5% or more, forms Al—Cr—Cu—Fe intermetallic compounds and acts to improve the strength at high temperatures (heat resistance). However, if the Cu content exceeds 5%, the element may form coarse compounds to thereby reduce the strength at high temperatures contrarily. The Cu content, if selectively contained, is set within a range of 0.5% to 5%, and more preferably within a range of 0.6% to 4.5%.

Magnesium (Mg), if contained in a content of 0.5% or more, forms Al—Mg—Cr intermetallic compounds and acts to improve the strength at high temperatures (heat resistance). However, if the Mg content exceeds 3%, the element may form coarse compounds to thereby reduce the strength at high temperatures contrarily. The Mg content, if selectively contained, is set within a range of 0.5% to 3%, and more preferably within a range of 0.6% to 2.5%.

(Nd)

Neodymium (Nd), if contained in a content of 0.2% or more, acts to improve the strength at high temperatures (heat resistance). However, if the Nd content exceeds 2%, the element may adversely affect the strength at high temperatures and toughness contrarily. Accordingly, the Nd content, if selectively contained, is set within a range of 0.2% to 2%, and more preferably within a range of 0.3% to 1.8%.

(Volume Percentage of Intermetallic Compound Phases)

If the volume percentage of intermetallic compound phases such as Al—Mn intermetallic compound phases, formed by the alloy elements in an aluminum based alloy, is excessively small, these intermetallic compound phases are insufficient in amount, and the aluminum metal matrix has an excessively large volume percentage. Thus, the aluminum based alloy may be insufficient in heat resistance, wear resistance, and rigidity.

In contrast, if the volume percentage of these intermetallic compound phases is excessively large, the elements may form coarse compound and may thereby adversely affect the heat resistance, wear resistance, and rigidity. In addition, the amount of the aluminum metal matrix may be excessively small, and the resulting aluminum based alloy may be insufficient in toughness, become brittle, and not be suitably used as a heat-resistant aluminum based alloy.

Figure 3:
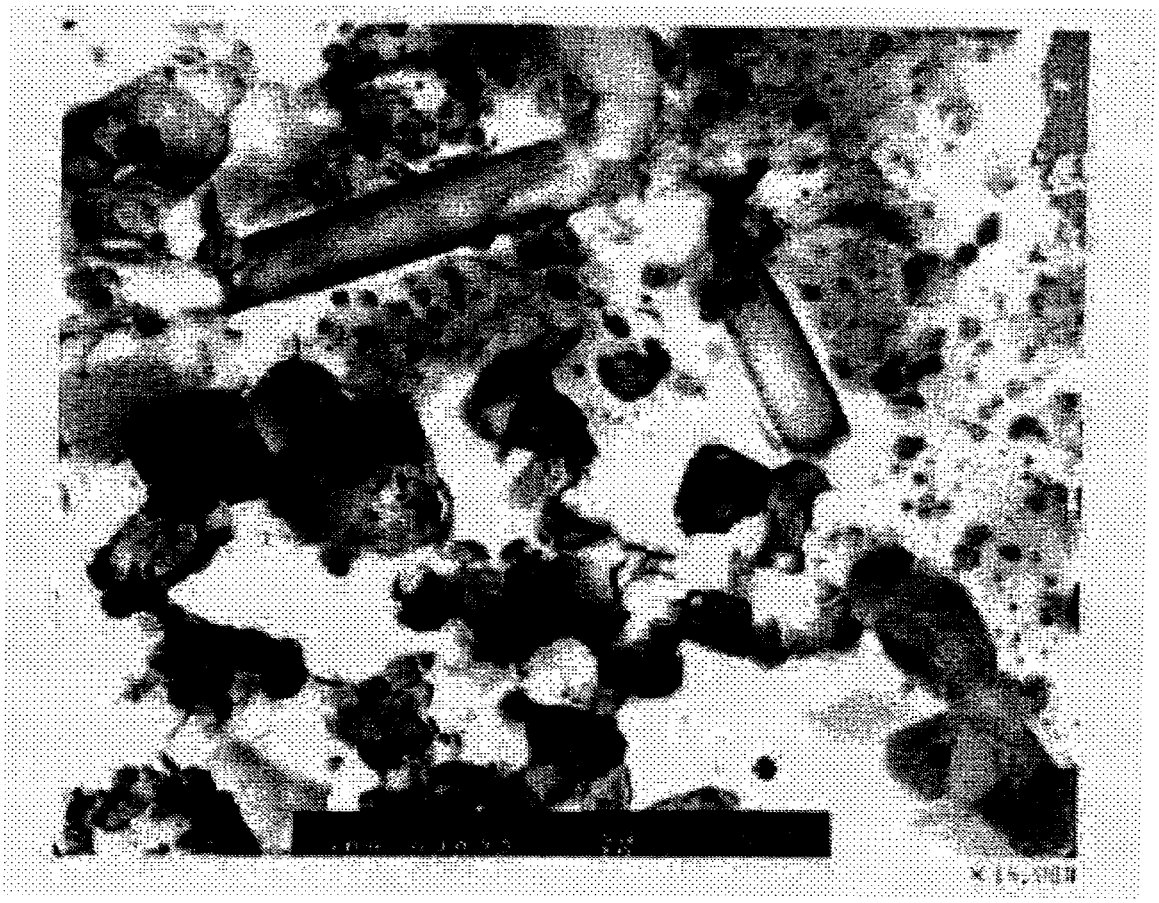
FIG. 3 is a photograph (in place of drawing) showing the structure of an aluminum based alloy as Inventive Sample 1-2 in Experimental Examples.

Accordingly, the aluminum based alloy structure should contain these specific intermetallic compound phases in a volume percentage of 35% to 80%, and preferably 40% to 75%. The term "intermetallic compound(s)" as used in the present invention refers to black to gray particles as shown in FIG. 3 (photograph showing the structure) in after mentioned Experimental Examples. The term "intermetallic compound phase" as used in the present invention refers to the aggregate (continuous body) formed by the respective intermetallic compound particles in contact with each other.

(Average Size of Intermetallic Compounds)

The average size of intermetallic compounds (particles), including Al—Mn intermetallic compounds, in the structure of an aluminum based alloy according to an embodiment of the present invention may be reduced to preferably 5 μm or less, and more preferably 4.5 μm or less, in order to improve the elongation properties and workability of the aluminum based alloy, as is described above. By finely dividing the intermetallic compounds so as to have such a small average size, the aluminum based alloy is also improved in toughness.

The strength at high temperatures increases with increasing contents of respective alloy elements and increasing amounts of intermetallic compounds in the present invention. In this case, however, the average size of intermetallic compounds more affects the toughness of the aluminum based alloy than aluminum based alloys containing alloy elements in less amounts. In this connection, when intermetallic compounds have an average size of more than 5 μm, the resulting aluminum based alloy may be insufficient in toughness and other properties, even if it satisfies the above conditions.

(Determination of Average Size of Intermetallic Compounds)

The average size of intermetallic compounds (intermetallic compound particles) was determined using a transmission electron microscope (TEM) of a magnification of 5000 to 15000 times in combination with an energy dispersive X-ray spectroscope (EDX). Specifically, intermetallic compounds were traced in an observed image of the structure in visual field of TEM, central diameters of intermetallic compound particles were determined using an image analyzing software Image-ProPlus supplied from MEDIA CYBERNETICS, Inc., and the central diameters were averaged. Ten visual fields were observed, and the average sizes in individual visual fields were further averaged to determine the average size of intermetallic compounds.

(Al—Mn Intermetallic Compound Phase)

The metallographic structure of an aluminum based alloy according to an embodiment of the present invention contains intermetallic compound phases including an Al—Mn phase as a principal phase. In the structure of an aluminum based alloy according to the present invention, Al—Mn intermetallic compounds form, for example, intermetallic compounds such as $Al_6Mn$, $Al_4Mn$, $Al_{12}Mn$, Al-(Mn, Fe), Al-(Mn, Fe)—Si, and Al-(Mn, Fe)—V—Si intermetallic compounds. The term "Al—Mn intermetallic compound(s)" as used in the present invention refers to an intermetallic compound belonging to these and other intermetallic compounds each containing Mn, in which Mn has the largest content next to aluminum, among elements (analyzed elements) constituting the intermetallic compound, as determined by the after-mentioned analysis process.

An aluminum based alloy can have both excellent Young's modulus at ordinary temperature and excellent Young's modulus at high temperatures when it contains Al—Mn intermetallic compounds as a principal phase. The Young's modulus at ordinary temperature and Young's modulus at high temperatures indicates the rigidity of an aluminum based alloy.

When the Al—Mn intermetallic compound phases further contain, as solid solution, one or more of other alloy elements selected from V, Cr, Fe, Si, and Ni, the Al—Mn intermetallic compounds and the resulting aluminum based alloy can have improved strength, toughness, and hardness (strength at high temperatures and wear resistance), as compared with those not containing one or more of these elements as a solid solution. These alloy elements form intermetallic compounds.

To exhibit these advantages, the total amount of the alloy elements selected from V, Cr, Fe, Si, and Ni and dissolved as a solid solution in Al—Mn intermetallic compound phases should be 10 percent by mass or more, and preferably 11 percent by mass or more. If the total amount of the dissolved alloy elements is less than the lower limit of 10 percent by mass, the aluminum based alloy may not have sufficiently improved strength, toughness, and hardness (strength at high temperatures and wear resistance).

(Quantitative Determination of Solid Solution in Al—Mn Intermetallic Compound Phases)

The amount of solid solutions of alloy elements in Al—Mn intermetallic compound phases is determined using a transmission electron microscope (TEM) at a magnification of 5000 to 15000 times, and an energy dispersive X-ray spectrometer (EDX) (supplied from Kevex Instruments (Thermo Fisher Scientific, Inc.), Sigma energy dispersive X-ray spectrometer) at a magnification of 45000 times equipped with TEM. Specifically, of intermetallic compounds containing Mn observed in the visual field of TEM, an intermetallic compound in which Mn has the largest content next to aluminum is identified as an Al—Mn intermetallic compound using this analysis system. Each ten points, for example, in the identified Al—Mn intermetallic compounds are arbitrarily selected respectively, and the total amounts of solid solutions of the above-mentioned elements in the Al—Mn intermetallic compounds are measured, and the measured values are averaged.

(Solid Solution of Respective Elements in Metallic Aluminum)

A total of 0.1 to 10 percent by mass of the alloy elements are preferably dissolved in the aluminum metal matrix to form a solid solution, in addition to the solid solution in the Al—Mn intermetallic compound phases. This increases the strength of the aluminum metal matrix, and the aluminum based alloy can have improved wear resistance even when used in heat-resistant machine parts, because the aluminum metal matrix can maintain hard intermetallic compound phases on its surface.

If the total amount of solid solutions of the respective alloy elements is less than 0.1 percent by mass, the strength of the aluminum metal matrix may not be increased to such an extent as to maintain the hard intermetallic compound phases on its surface. In contrast, if the total amount of solid solutions of the respective alloy elements exceeds 10 percent by mass, the aluminum metal matrix may become brittle contrarily to have decreased toughness. The resulting aluminum based alloy may not be suitably used in heat-resistant machine parts.

When an aluminum based alloy contains V, Cr, Fe, Si, and/or Ni alone in addition to Mn, the term "total amount of solid solutions of the respective alloy elements" refers to the total amount of solid solutions of these alloy elements. When the aluminum based alloy further contains either one or both of Cu and Mg, the term refers to the total amount of solid solutions of the alloy elements V, Cr, Fe, Si, Ni, Cu, and Mg. When the aluminum based alloy further contains Nd, the term refers to the total amount of solid solutions of the alloy elements further including Nd.

(Quantitative Determination of Solid Solution in Aluminum Matrix)

Quantitative determination of solid solutions of alloy elements in the aluminum metal matrix may be carried out in the same manner as in the quantitative determination of solid solutions of alloy elements in the Al—Mn intermetallic compound phases. Specifically, the quantitative determination may be carried out using a transmission electron microscope (TEM) at a magnification of 5000 to 15000 times, and an energy dispersive X-ray spectrometer (EDX) (supplied from Kevex Instruments (Thermo Fisher Scientific, Inc.), Sigma energy dispersive X-ray spectrometer) at a magnification of 45000 times equipped with TEM. More specifically, using this analysis system, each ten points, for example, in the aluminum metal matrix in the visual field of TEM are arbitrarily selected respectively, and the total amounts of solid solutions of the above-mentioned elements are measured, and the measured values in the ten view fields are averaged.

(Manufacturing Process)

A manufacturing process of aluminum based alloys according to an embodiment of the present invention will be illustrated below. The structures and properties of aluminum based alloys according to an embodiment of the present invention may be obtained by subjecting aluminum alloy preforms prepared by rapid solidification to densification through CIP or HIP. The preforms may be further subjected, as intact or after CIP or HIP, to hot working (plastic working) such as forging, extruding, and/or rolling.

It is difficult to prepare aluminum based alloys according to the present invention by a common melting and scanning procedure, because they contain large amounts of alloy elements and large amounts of deposited intermetallic compound phases. In addition, when aluminum alloy preforms prepared by rapid solidification or those after CIP or HIP are not subjected to such hot working, the structures and properties of aluminum based alloys according to the present invention may not be obtained.

(Rapidly Quenched Powder Metallurgy)

An aluminum based alloy according to the present invention may be manufactured by rapidly quenched powder metallurgy belonging to rapid solidification techniques. In this case, it is desirable to classify atomized particles (powder) of an aluminum alloy having the composition as specified in the present invention and to use finely divided particles having an average particle diameter of 20 μm or less, and preferably 10

μm or less. Atomized particles having an average particle diameter exceeding 20 μm are cooled too slowly and thereby cause coarse intermetallic compound phases. Accordingly, when atomized particles having an average particle diameter of more than 20 μm are used, an aluminum based alloy according to the present invention may not be possibly obtained. By compressing and molding finely divided particles having an average particle diameter of 20 μm or less alone by CIP, an aluminum alloy preform can be obtained.

(Spray Forming)

However, of rapid solidification techniques, spray forming is desirable to yield an aluminum based alloy structure in which alloy elements are sufficiently dissolved to form solid solutions in Al—Mn intermetallic compound phases and aluminum metal matrix.

The spray forming provides a significantly higher cooling/solidifying rate than common melting/casting (ingot making) techniques, can thereby dissolve predetermined amounts of alloy elements to form solid solutions in the intermetallic compounds and in the aluminum metal matrix, and enables further improved heat resistance and wear resistance of the aluminum based alloy. In other words, the cooling/solidifying rate of spray forming is suitable for forming respective intermetallic compound phases and for forcedly dissolving the alloy elements to form solid solutions in the aluminum metal matrix and intermetallic compounds.

However, the melting conditions and cooling/solidifying rate should be optimized in any of rapidly quenched powder metallurgy and spray forming. According to a preferred embodiment, an aluminum alloy having the composition as specified in the present invention is melted at a melting temperature of 1250° C. to 1600° C., the molten metal is cooled at a cooling rate of 200° C. per hour or more to a spray starting temperature, and the molten metal is started to spray at a temperature of 900° C. to 1200° C., to thereby yield a rapidly quenched powder, or a preform through spray forming.

(Melting Condition)

The melting temperature is set at 1250° C. or higher, in order to completely melt respective intermetallic compound phases in an aluminum alloy having the composition as specified in the present invention. When the aluminum based alloy has larger contents of alloy elements, it is desirable to set the melting temperature to a higher temperature of 1250° C. or higher, so as to completely melt respective intermetallic compound phases. There is no need, however, of setting the melting temperature higher than 1600° C.

(Spraying Condition)

It is desirable to cool the molten metal at a cooling rate of 200° C. per hour or more to a spray starting temperature, and to start the spraying of the molten metal at a temperature of 900° C. to 1200° C., to form a rapidly quenched powder, or to yield a preform through spray forming. The metal is melted at a high temperature in order to completely melt intermetallic compound phases. The molten metal is once cooled before starting the spraying. This is effective for crystallizing an intermetallic compound to some extent and for crystallizing fine crystals of other intermetallic compounds with the crystals of the crystallized intermetallic compound as nuclei during spray forming. By starting the spraying at a relatively low temperature, the cooling rate of spraying can be increased to thereby yield crystallized intermetallic compounds having further reduced sizes.

More specifically, such a pattern control is carried out as to cool the molten metal at a cooling rate of 200° C. per hour or more to a spray starting temperature. By this pattern control, Al—Cr and Al—Fe intermetallic compounds are crystallized to some extent before starting to spray. These intermetallic compounds are effective for finely dividing other intermetallic compounds. Using crystals of these intermetallic compounds as nuclei, Al—Mn intermetallic compounds are crystallized as fine crystals during spraying. Without carrying out this pattern control, crystallized intermetallic compounds may not form fine particles.

If the cooling rate of the molten metal to the spray starting temperature is less than 200° C. per hour, the intermetallic compounds may not be crystallized as fine crystals, and the crystallized intermetallic compounds may not have sufficiently small sizes.

The spray starting temperature of the molten metal affects the cooling/crystallizing rate during the spraying process. Specifically, the spray starting temperature of the molten metal is preferably low for the purpose of increasing the cooling rate. However, if the spray starting temperature is lower than 900° C., intermetallic compounds may be crystallized in the molten metal before the spraying process, and this may often cause clogging of nozzles. In contrast, if the spray starting temperature exceeds 1200° C., the cooling rate during the spraying process may be excessively low, and this may often cause coarse intermetallic compounds.

It is important to set the cooling rate in the spraying process (spray forming process) at a sufficiently high rate. At such a sufficiently high cooling rate, crystal nuclei of intermetallic compounds form at a high frequency to thereby prevent the occurrence of coarse intermetallic compound particles and to form finely divided intermetallic compound phases. In addition, such finely divided intermetallic compound particles come in contact with adjacent particles at a less frequency to thereby yield intermetallic compound phases having less outer sizes.

In this connection, general spray forming techniques are oriented to yield compact or dense preforms so as to improve the strength. Accordingly, the cooling rate is set at low level so as to yield such a loose solidification state as to form dense preforms. As a result, it is difficult to form fine intermetallic compound phases according to the general spray forming techniques. For example, when a preform has a porosity of 1 percent by mass or less as in Patent Document 4, the cooling rate is apparently excessively low, and, as a natural next step, fine intermetallic compound phases as in the present invention are not obtained, and the resulting intermetallic compound phases are coarse.

(Cooling Condition)

The cooling rate during the forming process of rapidly quenched powder or spray forming (during the spraying process) can be controlled, for example, by a gas/metal ratio (G/M ratio: the amount of a gas blown to a unit mass of the molten metal). In the present invention, the G/M ratio is preferably higher so as to yield a higher cooling rate. This yields fine intermetallic compound phases as specified in the present invention, and predetermined amounts of respective elements can be dissolved in the aluminum metal matrix. Other elements than those constituting the intermetallic compounds can be forcedly dissolved in intermetallic compound phases.

If the G/M ratio is excessively low, the cooling rate may be insufficient, and it may be difficult to dissolve predetermined amounts of respective elements in the aluminum metal matrix and to dissolve other elements than those constituting the intermetallic compounds in intermetallic compound phases forcedly. In addition, the resulting intermetallic compound phases may be coarse. However, an excessively high G/M ratio may reduce the yield of preform (deposition efficiency of the molten metal).

It is recommended to set the lower limit of the G/M ratio satisfying these conditions to, for example, 8 $Nm^3$/kg or more, preferably 9 $Nm^3$/kg or more, and more preferably 10 $Nm^3$/kg or more, and the upper limit of the G/M ratio to, for example, 20 $Nm^3$/kg or less, and preferably 17 $Nm^3$/kg or less.

(Densification)

A powder prepared by rapidly quenched powder metallurgy is subjected to CIP and is then encapsulated in vacuo to yield an aluminum alloy preform. An aluminum alloy in the form of a preform prepared by spray forming is hermetically sealed in a vacuum vessel and then subjected to HIP.

Conditions in hot isostatic pressing (HIP) are not specifically limited, but it is recommended to carry out HIP on the preform encapsulated in a vacuum vessel, for example, at a temperature of 450° C. to 600° C. and a pressure of 80 MPa (800 atmospheres) or more for 1 to 10 hours. This heat treatment process acts to further deposit Al—Mn precipitates to thereby reduce the average size of intermetallic compounds. If the temperature and pressure are excessively low, or if the process time is excessively short, pores may often remain. If the temperature is excessively high or the time is excessively long, intermetallic compound phases may often become coarse, and solid solutions in aluminum matrix may decrease in amount.

From this point, the temperature is preferably within a range of about 500° C. to about 600° C., and especially preferably about 550° C. to about 600° C., and the pressure is preferably 900 MPa or more, and especially preferably 1000 MPa or more. The upper limit of the pressure is not specifically limited, but the pressure is generally set to 2000 MPa or less, because an excessively high pressure does not further increase the advantages. The process time is preferably about 1 to about 5 hours, and especially preferably about 1 to about 3 hours.

Aluminum based alloys after the HIP as intact or after further subjected to proper processing such as machining are used as aluminum based alloy products.

(Hot Working)

An aluminum based alloy after densification may further subjected to hot working such as forging, extruding, or rolling. A powder prepared by rapidly quenched powder metallurgy may also be subjected to the hot working, after being subjected to solidification (molding) through CIP and/or HIP to yield an aluminum based alloy (preform).

The hot working (plastic working) enables more fine and uniform dispersion of intermetallic compound phases in the aluminum based alloy structure and ensures more amounts of solid solutions of respective elements in the aluminum metal matrix. However, the processing temperature in the hot working such as forging, extruding, and/or rolling is preferably set within a relatively low range of 400° C. to 450° C., in order to ensure sufficient amounts of solid solutions of respective elements in the aluminum metal matrix. Hot working carried out at temperatures within this range enables further fine and uniform dispersion of intermetallic compound phases and ensures further amounts of solid solutions of respective elements in the aluminum metal matrix.

If the processing temperature in hot working is as high as exceeding 450° C., intermetallic compound phases may excessively deposit, sufficient amounts of intermetallic compounds dissolved in the aluminum matrix may not be obtained, and intermetallic compound phases may become coarse. In contrast, if the processing temperature is lower than 400° C., effectively fine intermetallic compounds may not be obtained even by hot working.

Likewise, the strain rate in such hot working is preferably set within a relatively low range of $10^{-4}$ to $10^{-1}$ (1/s). If the strain rate is higher than this range, the advantages of hot working may not be sufficiently obtained. If the strain rate is lower than this range, intermetallic compound phases may deposit to thereby fail to ensure sufficient amounts of solid solutions of the added elements in the aluminum matrix, and the intermetallic compound phases may possibly become coarse.

Aluminum based alloys after the hot working are used as aluminum based alloy products as intact or after further subjected to proper processing such as machining.

Experimental Example 1

The present invention will be illustrated in further detail with reference to several examples below. It should be noted, however, the following examples are never intended to limit the scope of the present invention, and appropriate modifications and variations without departing from the spirit and scope of the present invention set forth above and below fall within the technological scope of the present invention.

A series of preforms were prepared by melting aluminum alloys having the component compositions in following Table 1 at a melting temperature of 1200° C. to yield molten metals; cooling the molten metals at a cooling rate of 100° C. per hour or more to predetermined spray starting temperatures; starting the spraying of molten metals at temperatures of 1000° C. to 1100° C.; and thus carrying out spray forming at G/M ratios of 2 to 10, respectively, using nitrogen ($N_2$) gas. The spray forming conditions including the melting temperature, spray starting temperature, and average G/M ratio (unit: $Nm^3$/kg) in respective Inventive Samples and Comparative Samples are also shown in Table 1.

The respective preforms were placed in stainless steel cans, and were evacuated by holding at a temperature of 400° C. and a reduced pressure of 13 kPa (100 Torr) or less for 2 hours, and the cans were hermetically sealed to thereby yield capsules. These capsules (evacuated materials) as intact were subjected to hot forging under the conditions of forging temperature and forging rate (strain rate) in Table 1, to yield round rods. Thus, aluminum based alloys (test samples) were obtained.

The structures and properties of these aluminum based alloys after hot forging were determined and evaluated in the following manner. The results are shown in Table 2.

(Volume Percentage of Intermetallic Compound Phases)

The volume percentage of intermetallic compound phases in a sample aluminum based alloy structure was determined in the following manner. Specifically, the structure of the sample aluminum based alloy was observed in ten visual fields each about 80 μm wide and about 120 μm long using a scanning electron microscope at a magnification of 1000 times. The images in the visual fields were photographed or subjected to image processing. Intermetallic compound phases were distinguished from an aluminum metal phase in the structure in the visual fields based on images of reflection electrons, and the volume percentage of intermetallic compound phases in the visual fields was determined.

(Average Size of Intermetallic Compounds)

The average size of intermetallic compounds (intermetallic compound particles) was determined using a transmission electron microscope (TEM) of a magnification of 5000 to 15000 times in combination with an energy dispersive X-ray spectroscope (EDX). Specifically, intermetallic compounds were traced in an observed image of the structure in visual field of TEM (e.g., FIG. 1), central diameters of intermetallic compound particles were determined using an image analyzing software Image-ProPlus supplied from MEDIA CYBERNETICS, Inc., and the central diameters were averaged. Ten visual fields were observed, and the average sizes in individual visual fields were further averaged to determine the average size of intermetallic compounds.

(Identification of Intermetallic Compound Phases)

The crystal structures of intermetallic compounds were analyzed with an X-ray diffractometer (supplied from Rigaku Corporation, RINT 1500) to thereby determine whether there are intermetallic compounds belonging to any of Al—Mn—Si, Al—Mg—Cr, Al—Cr—Cu—Fe, and Al—V in the structure. Thus, the types of intermetallic compounds constituting the structure were identified.

(Greatest Lengths of Metallic Aluminum Pools)

The greatest lengths of aluminum metal pools (μm) were determined in the following manner. A test sample of a sample aluminum based alloy was subjected to mirror polishing. The structure of the polished surface of the aluminum based alloy was observed in each ten visual fields of about 200 μm wide and about 150 μm long with a scanning electron microscope (SEM) (supplied from Hitachi, Ltd., field emission-scanning electron microscopy (FE-SEM) Model S4500) at a magnification of 500 times or 1000 times according to the level of the greatest lengths, as is described above. In the reflection electron images, aluminum metal pools (aluminum metal phase) were observed as black images as in FIG. 2.

These black images in a visual field were traced, greatest lengths (largest central diameters) of respective aluminum metal pools (black images) were determined through image analysis using an image analyzing software Image-ProPlus supplied from MEDIA CYBERNETICS, Inc. Metallic aluminum pools in the visual field to be measured were set to be those each having a greatest length of 1 μm or more. The greatest lengths of all aluminum metal pools each having a greatest length of 1 μm or more in the visual field were determined, and the determined greatest lengths were averaged as the greatest length of aluminum metal pools in the visual field. In this connection, aluminum metal pools each having a greatest length of less than 1 μm were excluded (cut-off) from targets to be measured, because it is difficult to determine or measure such small areas, and they cause errors contrarily. This observation procedure was conducted in a total of ten visual fields, and the measured values in the ten view fields were further averaged. In the observation of structure, aluminum metal phases were distinguished from intermetallic compound phases in scanning electron micrographs (SEM) with an energy dispersive X-ray spectrometer (EDX) (supplied from Kevex Instruments (Thermo Fisher Scientific, Inc.), Sigma energy dispersive X-ray spectrometer). The observation was carried out through the reflection electron observation, so as to observe intermetallic compound phases clearly.

(Mechanical Properties)

As mechanical properties of these aluminum based alloys, the strength and elongation at room temperature and the strength (strength at high temperatures) and elongation at high temperature of 200° C. were determined.

(Strength and Elongation at High Temperature)

A test piece 4 mm in diameter in parallel portion and 15 mm length was prepared from a sample aluminum based alloy. The test piece was heated to 200° C., held at this temperature for 15 minutes, and subjected to a high-temperature tensile test at an elastic stress rate (tension speed) of 0.5 mm/min and a strain rate of $5\times10^{-4}$ (1/s). In addition, the test piece was subjected to room-temperature tensile test in the same manner as with the high-temperature tensile test, except for carrying out the test at a temperature of 15° C.

A sample having a high-temperature tensile strength of 330 MPa or more was evaluated to have good strength at high temperatures and to have good heat resistance. A sample having a high-temperature elongation of 15% or more was evaluated to have good high-temperature elongation.

(Workability)

Workabilities of these aluminum based alloys were evaluated in the following manner. A sample that had undergo hot forging normally without surface cracking at a predetermined relatively high forging rate was evaluated to have good workability. A sample that had undergone hot forging with surface cracking was evaluated to have poor workability.

Tables 1 and 2 demonstrate that Inventive Samples 1-1 to 8-1 have amounts of alloy elements and a total content of Mn, V, Cr, Fe, Si, Cu, and Mg (seven elements) both falling within the ranges as specified in the present invention and are manufactured under preferred manufacturing conditions including spray forming conditions and hot forging conditions.

Table 2 demonstrates that Inventive Samples 1-1 to 8-1 therefore each have such an aluminum based alloy structure as specified in the present invention, and that they are excellent in properties including hot workability and high-temperature properties. FIG. 1 shows the structure of Inventive Sample 1-1 observed under TEM at a magnification of 15000 times (photograph in place of drawing). The aluminum based alloy structure in FIG. 1 includes a granular intermetallic compound phase in a volume percentage of 50%, with the balance being an aluminum metal matrix, in which the granular intermetallic compound phase includes three or more of an Al—Mn—Si intermetallic compound phase, an Al—Mg—Cr intermetallic compound phase, an Al—Cr—Cu—Fe intermetallic compound phase, and an Al—V intermetallic compound phase.

However, Inventive Sample 8-1 contains intermetallic compounds that have an average size exceeding the preferred upper limit and are coarse. Consequently, Inventive Sample 8-1 is relatively insufficient in hot workability and high-temperature properties, as compared with other Inventive Samples (Table 2).

In contrast, Comparative Samples 9-1 to 19-1 did not satisfy any of the amounts (contents) of alloy elements and the total content of these seven alloy elements as specified in the present invention, or had not been manufactured under preferred manufacturing conditions including spray forming conditions and hot forging conditions.

Consequently, Comparative Samples 9-1 to 19-1 do not have aluminum based alloy structures as specified in the present invention and are poor in hot workability and high-temperature properties, as compared with Inventive Samples.

Comparative Sample 9-1 has a Mn content less than the lower limit, although being manufactured under preferred manufacturing conditions. Comparative Sample 10-1 has a Mn content exceeding the upper limit and contains only three of the intermetallic compound phases, although being manufactured under preferred manufacturing conditions. Comparative Sample 11-1 has a Si content less than the lower limit, although being manufactured under preferred manufacturing conditions. Comparative Sample 12-1 has a total content of the seven alloy elements exceeding the upper limit, although being manufactured under preferred manufacturing conditions. Comparative Sample 13-1 has a total content of the seven alloy elements less than lower limit, although being manufactured under preferred manufacturing conditions. Comparative Sample 14-1 was manufactured at an excessively high hot forging temperature and thereby has a volume percentage of intermetallic compound phases exceeding the upper limit of 80%, although having contents of the alloy elements and a total content of the respective alloy elements within ranges as specified in the present invention. Comparative Sample 15-1 has a volume percentage of intermetallic compound phases less than the lower limit of 35%, because it was manufactured at a relatively low hot forging temperature and has a total content of the alloy elements which falls within the range as specified in the present invention but is relatively low. Comparative Sample 16-1 has respective contents and a total content of the alloy elements within the ranges as specified in the present invention but relatively low and contains the intermetallic compound phases in a number of types of less than three. Comparative Sample 17-1 has a V content less than the lower limit, although being manufactured under preferred manufacturing conditions. Comparative Sample 18-1 has a Cr content less than the lower limit, although being manufactured under preferred manufacturing conditions. Comparative Sample 19-1 has an Fe content less than the lower limit, although being manufactured under preferred manufacturing conditions.

These results prove critical meanings of the respective requirements and preferred requirements in the present invention.

TABLE 1

| | | Chemical composition of aluminum based alloy (% by mass, the balance being aluminum) | | | | | | | | | Spray forming | | Hot forging | |
|---|---|---|---|---|---|---|---|---|---|---|---|---|---|---|
| Category | No. | Mn | V | Cr | Fe | Si | Cu | Mg | Ni | Total content of seven alloy elements other than Ni | Melting temperature (° C.) | Average G/M ratio | Forging temperature (° C.) | Forging rate (1/s) |
| Inventive Sample | 1-1 | 7.5 | 1 | 1 | 1 | 2.5 | 1.5 | 1 | 2.5 | 15.5 | 1200 | 9 | 500 | 0.010 |
| | 2-1 | 8 | 2 | 2 | 2 | 4 | 2 | 2 | 2 | 22 | 1200 | 9 | 500 | 0.010 |
| | 3-1 | 6 | 1 | 2 | 1 | 2 | 1 | 1 | 3 | 14 | 1200 | 9 | 500 | 0.010 |
| | 4-1 | 8 | 2 | 2 | 2 | 4 | 2 | 2 | 2 | 22 | 1200 | 9 | 520 | 0.010 |
| | 5-1 | 6 | 1 | 2 | 1 | 2 | 1 | 1 | 3 | 14 | 1200 | 9 | 480 | 0.010 |
| | 6-1 | 7.5 | 1 | 1 | 1 | 2.5 | 1.5 | 1 | 2.5 | 15.5 | 1200 | 9 | 550 | 0.010 |
| | 7-1 | 7.5 | 1 | 1 | 1 | 2.5 | 1.5 | 1 | 2.5 | 15.5 | 1200 | 9 | 450 | 0.010 |
| | 8-1 | 8 | 2 | 2 | 2 | 3 | 2 | 2 | 3.5 | 21 | 1200 | 9 | 600 | 0.001 |
| Comparative Sample | 9-1 | 4.5 | 1 | 1 | 1 | 2.5 | 1.5 | 1 | 2.5 | 12.5 | 1200 | 9 | 500 | 0.010 |
| | 10-1 | 13 | 1 | 1 | 1 | 2 | 1 | 1 | 2 | 20 | 1200 | 9 | 500 | 0.010 |
| | 11-1 | 7.5 | 1 | 1 | 1 | 0.7 | 1 | 1 | 2 | 13.2 | 1200 | 9 | 500 | 0.010 |
| | 12-1 | 9 | 4 | 3 | 2 | 5 | 4 | 2 | 2 | 29 | 1200 | 9 | 550 | 0.001 |
| | 13-1 | 5 | 0.5 | 1 | 1 | 1.5 | 1 | 1 | 3 | 11 | 1200 | 9 | 500 | 0.010 |
| | 14-1 | 8 | 2 | 3 | 4 | 5 | 2 | 2 | 2 | 18 | 1200 | 9 | 600 | 0.001 |
| | 15-1 | 6 | 1 | 1 | 1 | 2 | 1 | 1 | 2 | 13 | 1200 | 9 | 450 | 0.010 |
| | 16-1 | 5 | 4 | 0.5 | 0.5 | 1 | 0.5 | 0.5 | 3 | 12 | 1200 | 9 | 550 | 0.010 |
| | 17-1 | 7.5 | 0.3 | 1 | 1 | 2.5 | 1.5 | 1 | 2 | 14.8 | 1200 | 9 | 500 | 0.010 |
| | 18-1 | 7.5 | 1 | 0.3 | 1 | 2.5 | 1.5 | 1 | 2 | 14.8 | 1200 | 9 | 500 | 0.010 |
| | 19-1 | 7.5 | 1 | 1 | 0.3 | 2.5 | 1.5 | 1 | 2 | 14.8 | 1200 | 9 | 500 | 0.010 |

TABLE 2

| | | Aluminum based alloy structure | | | | Properties of aluminum based alloy | | | | | |
|---|---|---|---|---|---|---|---|---|---|---|---|
| | | | Intermetallic compound | | | | Properties | | | | |
| | | | | | | | at room temperature (15° C.) | | High-temperature properties (200° C.) | | |
| Category | No. | Average of greatest lengths of aluminum pools (μm) | Number of intermetallic compound phases a: Al—Mn—Si, b: Al—mg—Cr, c: Al—Cr—Cu—Fe, d: Al—V | Volume percentage (%) | Average size (μm) | Hot forging workability | Strength (MPa) | Elongation (%) | Strength (MPa) | Elongation (%) | Assessment |
| Inventive Sample | 1-1 | 15 | four types including a, b, c, and d | 50 | 3 | Good | 470 | 3 | 380 | 30 | Good |
| | 2-1 | 12 | four types including a, b, c, and d | 70 | 4 | Good | 520 | 2 | 420 | 15 | Good |
| | 3-1 | 20 | three types including a, b, and c | 45 | 2 | Good | 430 | 4 | 340 | 40 | Good |
| | 4-1 | 10 | four types including a, b, c, and d | 74 | 3 | Good | 540 | 2 | 430 | 20 | Good |
| | 5-1 | 25 | three types including a, b, and c | 41 | 3 | Good | 420 | 3 | 350 | 30 | Good |
| | 6-1 | 14 | three types including a, b, and c | 55 | 5 | Good | 490 | 3 | 390 | 25 | Good |
| | 7-1 | 20 | four types including a, b, c, and d | 45 | 2 | Good | 430 | 3 | 350 | 35 | Good |
| | 8-1 | 15 | four types including a, b, c, and d | 70 | 8 | Good | 420 | 2 | 340 | 16 | Good |
| Comparative Sample | 9-1 | 15 | four types including a, b, c, and d | 45 | 3 | Good | 430 | 2 | 320 | 8 | Poor |
| | 10-1 | 16 | two types including a and b | 60 | 2 | Poor | — | — | — | — | — |
| | 11-1 | 42 | three types including b, c, and d | 45 | 3 | Good | 420 | 2 | 310 | 25 | Poor |
| | 12-1 | 10 | four types including a, b, c, and d | 74 | 5 | Good | 480 | 0.5 | 380 | 8 | Poor |
| | 13-1 | 45 | three types including a, b, and c | 41 | 3 | Good | 400 | 3 | 320 | 30 | Poor |
| | 14-1 | 12 | four types including a, b, c, and d | 81 | 5 | Good | 490 | 0.5 | 390 | 8 | Poor |
| | 15-1 | 30 | three types including a, b, and c | 33 | 3 | Good | 390 | 3 | 310 | 30 | Poor |
| | 16-1 | 20 | two types including a and b | 55 | 4 | Poor | 460 | 2 | 370 | 15 | Poor |
| | 17-1 | 15 | three types including a, b, and c | 50 | 4 | Good | 435 | 2 | 325 | 25 | Poor |
| | 18-1 | 15 | two types including a and d | 50 | 4 | Poor | — | — | — | — | — |
| | 19-1 | 15 | three types including a, b, and d | 50 | 4 | Good | 430 | 2 | 320 | 25 | Poor |

Experimental Example 2

A series of preforms were prepared by melting aluminum alloys having the component compositions in following Table 3 at melting temperatures of 1300° C. to 1450° C. to yield molten metals; cooling the molten metals at cooling rates of 100° C. per hour or more to predetermined spray starting temperatures; starting the spraying of molten metals at temperatures of 1000° C. to 1200° C.; and thus carrying out spray forming at G/M ratios of 2 to 15, respectively, using nitrogen ($N_2$) gas. The spray forming conditions including the melting temperature, spray starting temperature, and average G/M ratio (unit: $Nm^3/kg$) in respective Inventive Samples and Comparative Samples are also shown in Table 3. In Table 3, a content of element indicated by "–" means that the content is equal to or lower than the detection limit.

The respective preforms were placed in stainless steel cans, and were evacuated by holding at a temperature of 400° C. and a reduced pressure of 13 kPa (100 Torr) or less for 2 hours, and the cans were hermetically sealed to thereby yield capsules. The capsules were subjected to HIP at a temperature of 550° C. and a pressure of 100 MPa (1000 atmospheres) for a holding time of 2 hours. Thus, dense aluminum based alloys (test samples) were obtained.

The structures and properties of these aluminum based alloys after HIP were determined and evaluated in the following manner. The results are shown in Table 4.

(Volume Percentage of Intermetallic Compound Phases)

The volume percentage of intermetallic compound phases in a sample aluminum based alloy structure was determined in the following manner. Specifically, the structure of the sample aluminum based alloy was observed in ten visual fields each about 80 μm wide and about 120 μm long using a scanning electron microscope (SEM) at a magnification of 1000 times. The images in the visual fields were photographed or subjected to image processing. Intermetallic compound phases were distinguished from an aluminum metal phase in the structure in the visual fields through EDX based on images of reflection electrons, and the volume percentage of intermetallic compound phases in the visual fields was determined.

(Average Size of Intermetallic Compounds)

The average size of intermetallic compounds (intermetallic compound particles) was determined using a transmission electron microscope (TEM) of a magnification of 5000 to 15000 times in combination with an energy dispersive X-ray spectroscope (EDX). Specifically, intermetallic compounds were traced in an observed image of the structure in visual field of TEM, central diameters of intermetallic compound particles were determined using an image analyzing software Image-ProPlus supplied from MEDIA CYBERNETICS, Inc., and the central diameters were averaged. Ten visual fields were observed, and the average sizes in individual visual fields were further averaged to determine the average size of intermetallic compounds.

(Amounts of Elements Dissolved in Manganese Intermetallic Compound Phase)

The crystal structures of respective intermetallic compound phases in the visual fields were analyzed through X-ray diffraction patterns and TEM electron diffraction patterns. Of the crystal structures, Al—Mn intermetallic compound phases, in which Mn has the highest content next to aluminum (Al) among the elements, were identified and distinguished from other intermetallic compounds. Thereafter, the structures of Al—Mn intermetallic compound phases at each ten points in the visual field were analyzed with a field emission-transmission electron microscope (FE-TEM) (supplied from Hitachi Ltd., Model HF-2000 field emission-transmission electron microscope) at a magnification of 15000 times in combination with an energy dispersive X-ray spectrometer (EDX) (supplied from Kevex Instruments (Thermo Fisher Scientific, Inc.), Sigma energy dispersive X-ray spectrometer) at a magnification of 45000 times attached with the TEM. The total amounts of solid solutions of V, Cr, Fe, Cu, Mg, Si, Ni, and Nd dissolved in intermetallic compound phases were determined and then averaged.

(Amounts of Elements Dissolved in Aluminum Metal Matrix)

The total amount of solid solutions of Mn, V, Cr, Fe, Cu, Mg, Si, Ni, and Nd dissolved in aluminum metal in each sample was determined in the same manner as in determination of the amounts of solid solutions using TEM-EDX.

(Strength)

For evaluating the heat resistance of a sample aluminum based alloy, strength at room temperature and strength at high temperatures (high-temperature strength) were determined. In the determination of high-temperature strength, a test piece 4 mm in diameter in parallel portion and 15 mm in length was prepared from a sample aluminum based alloy. The test piece was heated to 200° C., held at this temperature for 15 minutes, and subjected to a high-temperature tensile test at an elastic stress rate (tension speed) of 0.5 mm/min and a strain rate of $5\times10^{-4}$ (1/s). A sample having a high-temperature tensile strength of 300 MPa or more was evaluated to have good strength at high temperatures and to have good heat resistance. In addition, the test piece was subjected to room-temperature tensile test in the same manner as with the high-temperature tensile test, except for carrying out the test at a temperature of 15° C.

(Wear Resistance)

A pin-on-disk wear test was conducted as a high-temperature wear resistance test of a sample aluminum based alloy. The test sample was set on a pin member having a diameter of 7 mm, a length of 15 mm, and a weight of about 1 g. In addition, FC200 (cast iron) was used as a test disk member as a counter wear member. The test was conducted by bringing the test sample in contact with the rotating test disk member without lubricant for 10 minutes at a test temperature of 200° C., under a load of 10 kgf with a rotation radius of pin of 0.02 m. The wear resistance of the test sample was evaluated based on the abrasion loss in mass [((mass before test)−(mass after test))/(mass before test)]. A sample having an abrasion loss in mass of 0.2 g or less was evaluated to have good wear resistance at high temperatures.

(Young's Modulus)

A test piece having a diameter of 16 mm and a length of 10 mm was prepared for evaluating the rigidity of a sample aluminum based alloy. The Young's modulus at room temperature and that at high temperatures of the test piece were determined. The determination was carried out according to an ultrasonic method with an ultrasonic velocity measurement instrument (echometer) supplied from Nihon Matech Corporation (Model MBS 8000). The determination was conducted at room temperature and at 200° C.

Tables 3 and 4 demonstrate that Inventive Samples 1-2 to 8-2 each have amounts of respective alloy elements and a total content of these alloy elements both falling within the ranges as specified in the present invention. They contain Al—Mn intermetallic compound phases in their structure and have a volume percentage of intermetallic compound phases within the specific range. In addition, one or more of V, Cr, Fe, Cu, Mg, Si, Ni, and Nd are dissolved in the Al—Mn intermetallic compound phases in a total amount of the dissolved elements of 10 percent by mass or more. Further, the alloys were manufactured under preferred manufacturing conditions including spray forming conditions.

Inventive Samples 1-2 to 8-2 are therefore excellent in high-temperature strength, high-temperature wear resistance, and high-temperature rigidity (Table 4). FIG. 3 shows the structure of Inventive Sample 1-2 observed with FE-TEM at a magnification of 15000 times (photograph in place of drawing). The aluminum based alloy structure in FIG. 3 includes black or gray columnar or granular intermetallic compounds (phases) in a volume percentage of 50%, with the balance being white aluminum metal matrix surrounded by the intermetallic compounds. These columnar or granular intermetallic compounds are Al—Mn intermetallic compounds, and a total of 19% of V, Cr, Fe, Si, Ni, Cu, Mg, and/or Nd is dissolved to form a solid solution in the Al—Mn intermetallic compounds (phases).

However, Inventive Sample 8-2 contains intermetallic compounds having an average size larger than the preferred upper limit and thus being coarse. As a result, Inventive Sample 8-2 is relatively insufficient in high-temperature strength, high-temperature wear resistance, and high-temperature rigidity, as compared with other inventive samples (Table 4).

In contrast, Comparative Samples 9-2 to 18-2 do not satisfy any of the amounts of the respective alloy elements, the total content of these alloy elements, the volume percentage of intermetallic compound phases, and the total amount of solid solutions of the alloy elements dissolved in the Al—Mn intermetallic compound phases, or they were manufactured under such manufacturing conditions (spray forming conditions) as to be out of the preferred ranges as specified in the present invention.

Consequently, Comparative Samples 9-2 to 18-2 are poor in high temperature strength, high-temperature wear resistance, and/or high-temperature rigidity, as compared with Inventive Samples.

Comparative Samples 9-2 to 17-2 have amounts of the alloy elements out of the ranges specified in the present invention, although being manufactured under preferred manufacturing conditions. Comparative Sample 9-2 has a Mn content less than the lower limit. Comparative Sample 10-2 has a Mn content more than the upper limit. Comparative Sample 11-2 has a total content of the alloy elements less than the lower limit. Comparative Sample 12-2 has a total content of the alloy elements more than the upper limit. Comparative Sample 13-2 does not contain essential vanadium (V-less). Comparative Sample 14-2 does not contain essential chromium (Cr-less). Comparative Sample 15-2 does not contain essential iron (Fe-less). Comparative Sample does not contain essential nickel (Ni-less). Comparative Sample 17-2 does not contain essential silicon (Si-less). Comparative Sample 18-2 was manufactured at an excessively low average G/M ratio of 3 $Nm^3/kg$ in spray forming, although having the other factors within the same ranges as with Inventive Sample 1-2.

These results prove critical meanings of respective requirements and preferred requirements in the present invention.

TABLE 3

| | | Chemical composition of aluminum based alloy (% by mass, the balance being aluminum) | | | | | | | | | | Spray forming condition | | | |
|---|---|---|---|---|---|---|---|---|---|---|---|---|---|---|---|
| Category | No. | Mn | V | Cr | Fe | Ni | Si | Cu | Mg | Nd | Total content of these nine alloy elements | Melting temperature (° C.) | Spray starting temperature (° C.) | Average G/M ratio | Remarks |
| Inventive Sample | 1-2 | 7.5 | 1 | 1 | 1 | 2.5 | 2.5 | 1.5 | 1 | 1 | 19 | 1300 | 1100 | 10 | |
| | 2-2 | 8 | 2 | 2 | 2 | 3 | 3 | 2 | 2 | 2 | 26 | 1400 | 1200 | 12 | |
| | 3-2 | 9 | 3 | 3 | 2 | 3 | 5 | 1 | 1 | 1 | 28 | 1450 | 1200 | 8 | |
| | 4-2 | 7.5 | 1 | 1 | 1 | 2.5 | 2.5 | — | — | — | 18.5 | 1300 | 1000 | 11 | |
| | 5-2 | 7.5 | 1 | 1 | 1 | 2.5 | 2.5 | 3 | — | — | 18.5 | 1300 | 1100 | 11 | |
| | 6-2 | 7.5 | 1 | 1 | 1 | 2.5 | 2.5 | — | 2 | — | 17.5 | 1300 | 1100 | 11 | |
| | 7-2 | 7.5 | 1 | 1 | 1 | 2.5 | 2.5 | — | — | 2 | 17.5 | 1300 | 1100 | 11 | |
| | 8-2 | 9.5 | 1 | 1 | 1 | 2.5 | 2.5 | 1.5 | 1 | 1 | 21 | 1450 | 1200 | 9 | |
| Comparative Sample | 9-2 | 4.5 | 1 | 1 | 1 | 2.5 | 2.5 | 1.5 | 1 | 1 | 16 | 1300 | 1100 | 8 | excessively low Mn content |
| | 10-2 | 13 | 1 | 1 | 1 | 1 | 2 | 1 | 1 | 1 | 22 | 1400 | 1200 | 8 | excessively high Mn content |
| | 11-2 | 5 | 0.5 | 1 | 1 | 1 | 1.5 | 1 | 1 | 0.5 | 13 | 1300 | 1100 | 10 | excessively low total content of elements |
| | 12-2 | 9 | 4 | 3 | 4 | 4 | 5 | 3 | 2 | 1 | 36 | 1450 | 1200 | 10 | excessively high total content of elements |
| | 13-2 | 7.5 | — | 1 | 1 | 2.5 | 2.5 | 1.5 | 1 | 1 | 18 | 1300 | 1100 | 8 | V-less |
| | 14-2 | 7.5 | 1 | — | 1 | 2.5 | 2.5 | 1.5 | 1 | 1 | 18 | 1300 | 1100 | 8 | Cr-less |
| | 15-2 | 7.5 | 1 | 1 | — | 2.5 | 2.5 | 1.5 | 1 | 1 | 18 | 1300 | 1100 | 8 | Fe-less |
| | 16-2 | 7.5 | 2.5 | 1 | 1 | — | 2.5 | 1.5 | 1 | 1 | 18 | 1300 | 1100 | 8 | Ni-less |
| | 17-2 | 7.5 | 2.5 | 1 | 1 | 2.5 | — | 1.5 | 1 | 1 | 18 | 1300 | 1100 | 8 | Si-less |
| | 18-2 | 7.5 | 1 | 1 | 1 | 2.5 | 2.5 | 1.5 | 1 | 1 | 19 | 1300 | 1100 | 3 | under-G/M ratio |

TABLE 4

| | | Aluminum based alloy structure | | | | Properties of aluminum based alloy | | | | | |
|---|---|---|---|---|---|---|---|---|---|---|---|
| | | Amount of alloy | Intermetallic compound | | | Strength | | | Young's modulus | | |
| Category | No. | elements dissolved in aluminum matrix (%) | Amount of alloy elements dissolved in Al—Mn intermetallic compound phase (%) | Volume percentage (%) | Average size (μm) | Room temperature 15° C. (MPa) | High temperature 200° C. (MPa) | Wear resistance 200° C. (g) | Room temperature 15° C. (GPa) | High temperature 200° C. (GPa) | Assessment |
| Inventive Sample | 1-2 | 3.5 | 19 | 50 | 0.9 | 480 | 410 | 0.05 | 100 | 94 | Good |
| | 2-2 | 5.0 | 25 | 68 | 0.8 | 550 | 460 | 0.03 | 120 | 115 | Good |
| | 3-2 | 0.5 | 12 | 75 | 3.5 | 420 | 380 | 0.15 | 125 | 120 | Good |
| | 4-2 | 1.0 | 15 | 50 | 1.8 | 390 | 330 | 0.11 | 99 | 90 | Good |
| | 5-2 | 2.5 | 18 | 52 | 1.5 | 420 | 380 | 0.08 | 101 | 95 | Good |
| | 6-2 | 2.1 | 17 | 51 | 1.2 | 410 | 370 | 0.07 | 101 | 96 | Good |
| | 7-2 | 2.3 | 16 | 51 | 1.4 | 400 | 350 | 0.06 | 100 | 94 | Good |
| | 8-2 | 3.1 | 22 | 60 | 2.1 | 430 | 400 | 0.10 | 110 | 100 | Good |
| Comparative Sample | 9-2 | 0.5 | 11 | 30 | 0.8 | 303 | 180 | 0.35 | 81 | 76 | Poor |
| | 10-2 | 1.0 | 11 | 85 | 6.5 | brittle fracture | brittle fracture | 0.25 (chipping) | 100 | 93 | Poor |
| | 11-2 | 0.05 | 5 | 32 | 3.0 | 320 | 280 | 0.27 | 80 | 75 | Poor |
| | 12-2 | 5.0 | 15 | 90 | 8.0 | brittle fracture | brittle fracture | 0.5 (chipping) | 128 | 121 | Poor |
| | 13-2 | 1.5 | 8 | 50 | 1.5 | 400 | 350 | 0.25 | 98 | 89 | Poor |
| | 14-2 | 1.2 | 8 | 51 | 1.3 | 395 | 360 | 0.28 | 99 | 90 | Poor |
| | 15-2 | 1.1 | 9 | 50 | 1.4 | 405 | 340 | 0.23 | 97 | 89 | Poor |
| | 16-2 | 1.0 | 8 | 50 | 1.2 | 410 | 330 | 0.24 | 100 | 92 | Poor |
| | 17-2 | 0.6 | 6 | 50 | 1.0 | 390 | 310 | 0.30 | 95 | 80 | Poor |
| | 18-2 | 0.05 | 8 | 55 | 7.2 | 330 | 295 | 0.25 | 101 | 90 | Poor |

INDUSTRIAL APPLICABILITY

As has been described above, according to the present invention, there is provided an aluminum based alloy that is lightweight, has high strength and excellent elongation properties at high temperatures of around 200° C. to 300° C., and is excellent in workability in hot working. The aluminum based alloy is applicable to machine parts requiring strength at high temperatures, including automobile or aircraft components such as pistons and connecting rods. It is also applicable to extruded profile shapes (extrudings) requiring strength at high temperatures and lightness in weight, in uses such as members for precision machines with fine positioning accuracy, high-precision lightweight robot arms, lightweight high-rigidity plate ring chucks, high-precision micro hard disk substrates, and lightweight framed constructional materials.

There is also provided a heat-resistant aluminum based alloy that is lightweight and has high strength at high temperatures of around 200° C. to 300° C., high wear resistance, and high rigidity, according to the present invention. The aluminum based alloy is therefore applicable to various parts requiring heat resisting properties, including automobile or aircraft parts such as pistons and connecting rods.

The invention claimed is:

1. A heat-resistant aluminum based alloy comprising, in terms of percent by mass, 5% to 10% of Mn;

0.5% to 5% of V;

0.5% to 5% of Cr;

0.5% to 5% of Fe;

1% to 8% of Si; and 0.5% to 5% of Ni; with the balance being aluminum and inevitable impurities, wherein the aluminum based alloy is prepared from an aluminum based alloy preform, where the preform is prepared by a process comprising spray forming at an average gas/metal ratio (G/M ratio) of from 8 $Nm^3$/kg to 20 $Nm^3$/kg;

the aluminum based alloy has a structure including 35 to 80 percent by volume of an intermetallic compound phase with the balance being an aluminum metal matrix;

the intermetallic compound phase in the aluminum based alloy structure has an average size of 5 μm or less;

the aluminum based alloy at 200° C. has a tensile strength in a range of from 330 MPa to 460 MPa and an elongation in a range of from 15% to 40%, wherein the aluminum based alloy has a total content of Mn, V, Cr, Fe, Si, Cu, and Mg of 12% to 28%, and wherein the intermetallic compound phase comprises three or more different intermetallic compound phases selected from an Al—Mn—Si intermetallic compound phase, an Al—Mg—Cr intermetallic compound phase, an Al—Cr—Cu—Fe intermetallic compound phase, and an Al—V intermetallic compound phase.

2. The heat-resistant aluminum based alloy according to claim 1, further comprising 5% or less (excluding 0%) of Cu; and 3% or less (excluding 0%) of Mg.

3. The heat-resistant aluminum based alloy according to claim 1, further comprising 0.2% to 2% of Nd.

4. A heat-resistant aluminum based alloy comprising, in terms of percent by mass, 5% to 10% of Mn;

0.5% to 5% of V;

0.5% to 5% of Cr;

0.5% to 5% of Fe;

1% to 8% of Si; and 0.5% to 5% of Ni; with the balance being aluminum and inevitable impurities, wherein the aluminum based alloy is prepared from an aluminum based alloy preform, where the preform is prepared by a process comprising spray forming at an average gas/metal ratio (G/M ratio) of from 8 $Nm^3$/kg to 20 $Nm^3$/kg;

the aluminum based alloy has a structure including 35 to 80 percent by volume of an intermetallic compound phase with the balance being an aluminum metal matrix;

the intermetallic compound phase in the aluminum based alloy structure has an average size of 5 μm or less;

the aluminum based alloy at 200° C. has a tensile strength in a range of from 330 MPa to 460 MPa and an elongation in a range of from 15% to 40%, wherein the aluminum based alloy has a total content of Mn, V, Cr, Fe, Si, and Ni of 15% to 30%, wherein the intermetallic compound phase has a structure including an Al—Mn intermetallic compound phase, wherein one or more elements selected from V, Cr, Fe, Si, and Ni are dissolved in the Al—Mn intermetallic compound phase to form a solid solution, and wherein the total amount of the dissolved elements is 10 percent by mass or more.

5. The heat-resistant aluminum based alloy according to claim 4, wherein a total of 0.1 to 10 percent by mass of one or more elements selected from V, Cr, Fe, Si, and Ni is dissolved in the aluminum metal matrix to form a solid solution.

6. The heat-resistant aluminum based alloy according to claim 4, wherein either one or both of Cu and Mg are further dissolved in the Al—Mn intermetallic compound phase to form a solid solution, and wherein the total amount of the dissolved elements further including Cu and Mg is 10 percent by mass or more.

7. The heat-resistant aluminum based alloy according to claim 4, wherein a total of 0.1 to 10 percent by mass of one or more elements selected from V, Cr, Fe, Si, Ni, Cu, and Mg is dissolved in the aluminum metal matrix.

8. The heat-resistant aluminum based alloy according to claim 4, wherein Nd is further dissolved in the Al—Mn intermetallic compound phase to form a solid solution, and wherein the total amount of the dissolved elements further including Nd is 10 percent by mass or more.

9. The heat-resistant aluminum based alloy according to claim 4, wherein one or more elements selected from V, Cr, Fe, Si, Ni, and Nd, or a total of 0.1 to 10 percent by mass of one or more elements selected from V, Cr, Fe, Si, Ni, Cu, Mg, and Nd are dissolved in the aluminum metal matrix to form a solid solution.

10. The heat-resistant aluminum based alloy according to claim 1, wherein the average of greatest lengths of aluminum metal pools divided by the intermetallic compound phase is 40 μm or less.

* * * * *